US012501960B2

(12) United States Patent
Mann et al.

(10) Patent No.: US 12,501,960 B2
(45) Date of Patent: Dec. 23, 2025

(54) FOOTWEAR WITH BOOTIES AND BOOTIE SECUREMENT SYSTEMS, AND METHODS FOR MANUFACTURING THE SAME

(71) Applicant: Ariat International, Inc., San Leandro, CA (US)

(72) Inventors: Sai Mann, Hayward, CA (US); Lars Erik MacLeod, South Lake Tahoe, CA (US)

(73) Assignee: Ariat International, Inc., San Leandro, CA (US)

( * ) Notice: Subject to any disclaimer, the term of this patent is extended or adjusted under 35 U.S.C. 154(b) by 3 days.

(21) Appl. No.: 18/427,658

(22) Filed: Jan. 30, 2024

(65) Prior Publication Data

US 2025/0134200 A1 May 1, 2025

Related U.S. Application Data

(60) Provisional application No. 63/593,931, filed on Oct. 27, 2023.

(51) Int. Cl.
*A43B 3/02* (2006.01)
*A43B 1/00* (2006.01)
*A43B 9/06* (2006.01)

(52) U.S. Cl.
CPC ..... *A43B 3/02* (2013.01); *A43B 1/00* (2013.01); *A43B 9/06* (2013.01)

(58) Field of Classification Search
CPC .... A43B 3/02; A43B 9/06; A43B 1/00; A43B 9/10; A43B 3/28
USPC ..... 36/109
See application file for complete search history.

(56) References Cited

U.S. PATENT DOCUMENTS

| | | | | |
|---|---|---|---|---|
| 529,880 | A | 11/1894 | Shippee | |
| 4,550,446 | A | 11/1985 | Herman | |
| 4,599,810 | A * | 7/1986 | Sacre | A43B 23/0255 36/83 |
| 5,659,914 | A | 8/1997 | Steinlauf | |
| 5,669,160 | A | 9/1997 | Pozzebon | |

(Continued)

FOREIGN PATENT DOCUMENTS

| | | | |
|---|---|---|---|
| CN | 201123445 | Y | 10/2008 |
| EP | 1300091 | A1 | 4/2003 |

(Continued)

*Primary Examiner* — Timothy K Trieu
(74) *Attorney, Agent, or Firm* — Kolitch Romano Dascenzo Gates LLC

(57) ABSTRACT

Footwear with an integrated bootie configured to receive and enclose a wearer's foot when the footwear is worn. The footwear includes an upper disposed over the bootie, a sole assembly secured to the upper and the bootie, and a bootie securement system that includes at least one anchor tab projecting from the bootie and secured to the sole assembly, such as to an insole of the sole assembly. The at least one anchor tab may be at least one of mechanically and adhesively secured to the sole assembly by at least one fixing element and a reinforcement adhesive, respectively, of the bootie securement system. In some examples, the bootie includes a bootie base with a waterproof gasket and the anchor tab extends from the gasket. In some examples, the footwear is waterproof footwear, such as a waterproof boot or a waterproof shoe. Methods of manufacturing the footwear also are disclosed.

20 Claims, 11 Drawing Sheets

(56) References Cited

U.S. PATENT DOCUMENTS

| | | | | |
|---|---|---|---|---|
| 5,720,117 | A | 2/1998 | Toschi | |
| 6,088,935 | A * | 7/2000 | Pavelescu | A43B 9/00 36/19 R |
| 6,467,116 | B1 | 10/2002 | Strickland | |
| 6,497,057 | B1 | 12/2002 | Lee et al. | |
| 7,055,267 | B2 | 6/2006 | Wilson et al. | |
| 7,380,353 | B2 | 6/2008 | Feller et al. | |
| 7,752,773 | B2 | 7/2010 | McCarron | |
| 8,296,970 | B2 | 10/2012 | Jessiman et al. | |
| 8,307,483 | B2 | 11/2012 | Haimerl | |
| 9,021,721 | B2 | 5/2015 | McCarron | |
| 9,078,489 | B2 | 7/2015 | Mueller | |
| 9,215,906 | B2 | 12/2015 | Polegato Moretti | |
| 9,282,781 | B2 | 3/2016 | Davis et al. | |
| 9,510,642 | B2 | 12/2016 | Polegato Moretti | |
| 9,578,920 | B2 | 2/2017 | Grott et al. | |
| 9,763,492 | B2 | 9/2017 | Polegato Moretti | |
| 9,814,280 | B2 | 11/2017 | Buck, IV et al. | |
| 11,284,668 | B2 | 3/2022 | Pierobon | |
| 11,672,305 | B2 | 6/2023 | Cooper | |
| 2001/0037587 | A1 | 11/2001 | Lu | |
| 2004/0139629 | A1 | 7/2004 | Wiener | |
| 2008/0244934 | A1 * | 10/2008 | Covatch | A43B 9/06 36/17 R |
| 2010/0011629 | A1 | 1/2010 | Bastianelli et al. | |
| 2013/0232825 | A1 | 9/2013 | Wiener et al. | |
| 2019/0116916 | A1 | 4/2019 | Burch | |
| 2022/0273075 | A1 | 9/2022 | MacLeod et al. | |

FOREIGN PATENT DOCUMENTS

| | | | |
|---|---|---|---|
| WO | WO199316612 | A1 | 9/1993 |
| WO | WO199608177 | A1 | 3/1996 |
| WO | WO2010066656 | A2 | 6/2010 |

* cited by examiner

FOOTWEAR WITH BOOTIES AND BOOTIE SECUREMENT SYSTEMS, AND METHODS FOR MANUFACTURING THE SAME

RELATED APPLICATION

This application claims priority to similarly titled U.S. Provisional Patent Application No. 63/593,931, which was filed on Oct. 27, 2023 and the disclosure of which is hereby incorporated by reference.

FIELD OF THE DISCLOSURE

The present disclosure relates generally to footwear, and more particularly to footwear with integrated booties.

BACKGROUND OF THE DISCLOSURE

Some conventional footwear includes an integrated bootie that is secured within the footwear between the sole and the upper of the footwear. Typically, these booties are secured within the footwear by adhesives applied between a bottom of the bootie and a top of the sole, and between a top of the bootie and the upper. Examples of such footwear with integrated booties include waterproof footwear, which typically includes a waterproof sole and at least one of a waterproof upper and a waterproof bootie.

A challenge with existing footwear with integrated booties is that the repeated action of putting on (AKA donning) and taking off (AKA doffing) the footwear can create sheer forces in regions of the footwear that over time cause the adhesive to fail and the bootie to partially or fully detach from the sole and/or the upper of the footwear. This may result in decreased performance of the footwear and/or an undesirable/uncomfortable experience for the wearer. This full or partial detachment of the bootie from the sole and/or upper can occur in any region of the footwear but is most often observed in a heel region of the footwear due to this region experiencing more significant sheer forces during the repetitive actions of donning and doffing of the footwear. Accordingly, there is a need for improved systems and methods for attaching booties within footwear.

SUMMARY OF THE DISCLOSURE

Footwear with an integrated bootie configured to receive and enclose a wearer's foot when the footwear is worn. The footwear includes an upper disposed over the bootie, a sole assembly secured to the upper and the bootie, and a bootie securement system. The sole assembly includes at least an outsole and an insole. The bootie securement system secures the bootie to the sole assembly, such as to an insole of the sole assembly. The bootie securement system includes at least one anchor tab projecting from the bootie and at least one fixing element and/or an adhesive that mechanically and/or adhesively secures the at least one anchor tab to the sole assembly, such as to the insole of the sole assembly. In some examples, the bootie includes a bootie base with a waterproof gasket, with at least one anchor tab extending from the gasket. In some examples, the anchor tab is secured between the insole and the outsole of the sole assembly. In some examples, the footwear is waterproof footwear, such as a waterproof boot or a waterproof shoe.

Methods for manufacturing footwear containing booties and bootie securement systems include securing a bootie to a sole assembly using a bootie securement system, attaching an upper to the bootie, lasting the upper to the insole, and securing the insole to an outsole of the sole assembly. In some examples, the securing the bootie to the sole assembly includes securing the bootie to the insole. In some examples, the securing the bootie to the sole assembly and/or to the insole of the sole assembly includes mechanically securing the bootie to the sole assembly and/or to the insole of the sole assembly using at least one fixing element. In some examples, the securing the bootie to the sole assembly and/or to the insole of the sole assembly includes adhesively securing the bootie to the sole assembly and/or the insole of the sole assembly using a reinforcement adhesive.

DETAILED DESCRIPTION AND BEST MODE OF THE DISCLOSURE

Figure 1:
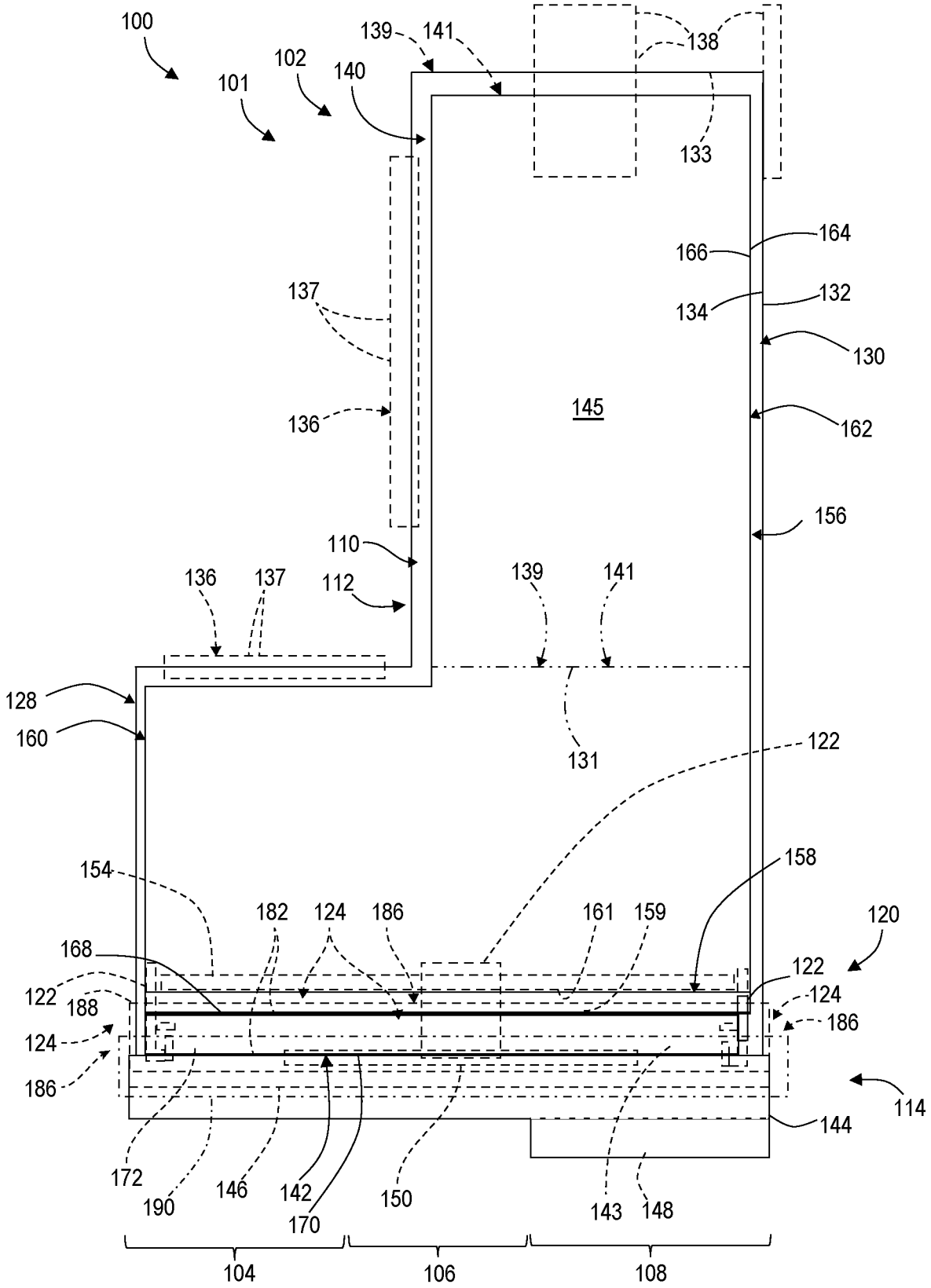
FIG. 1 is a schematic side elevation view illustrating examples of footwear with a bootie and a bootie securement system according to aspects of the present disclosure.

FIGS. 1-12 provide examples of footwear with booties and bootie securement systems, and of methods for manufacturing footwear with booties and bootie securement systems. Elements that serve a similar, or at least substantially similar, purpose are labeled with like numbers in each of FIGS. 1-12, and these elements may not be discussed in detail herein with reference to each of FIGS. 1-12. Similarly, all elements may not be labeled in each of FIGS. 1-12, but reference numerals associated therewith may be utilized herein for consistency. Elements, components, and/or features that are discussed herein with reference to one or more of FIGS. 1-12 may be included in and/or utilized with any of FIGS. 1-12 without departing from the scope of the present disclosure. In general, elements that are likely to be included in a particular embodiment are illustrated in solid lines, while elements that may be optional are illustrated in dashed lines. However, elements that are shown in solid lines may not be essential to all embodiments and, in some embodiments, may be omitted without departing from the scope of the present disclosure.

Figure 10:
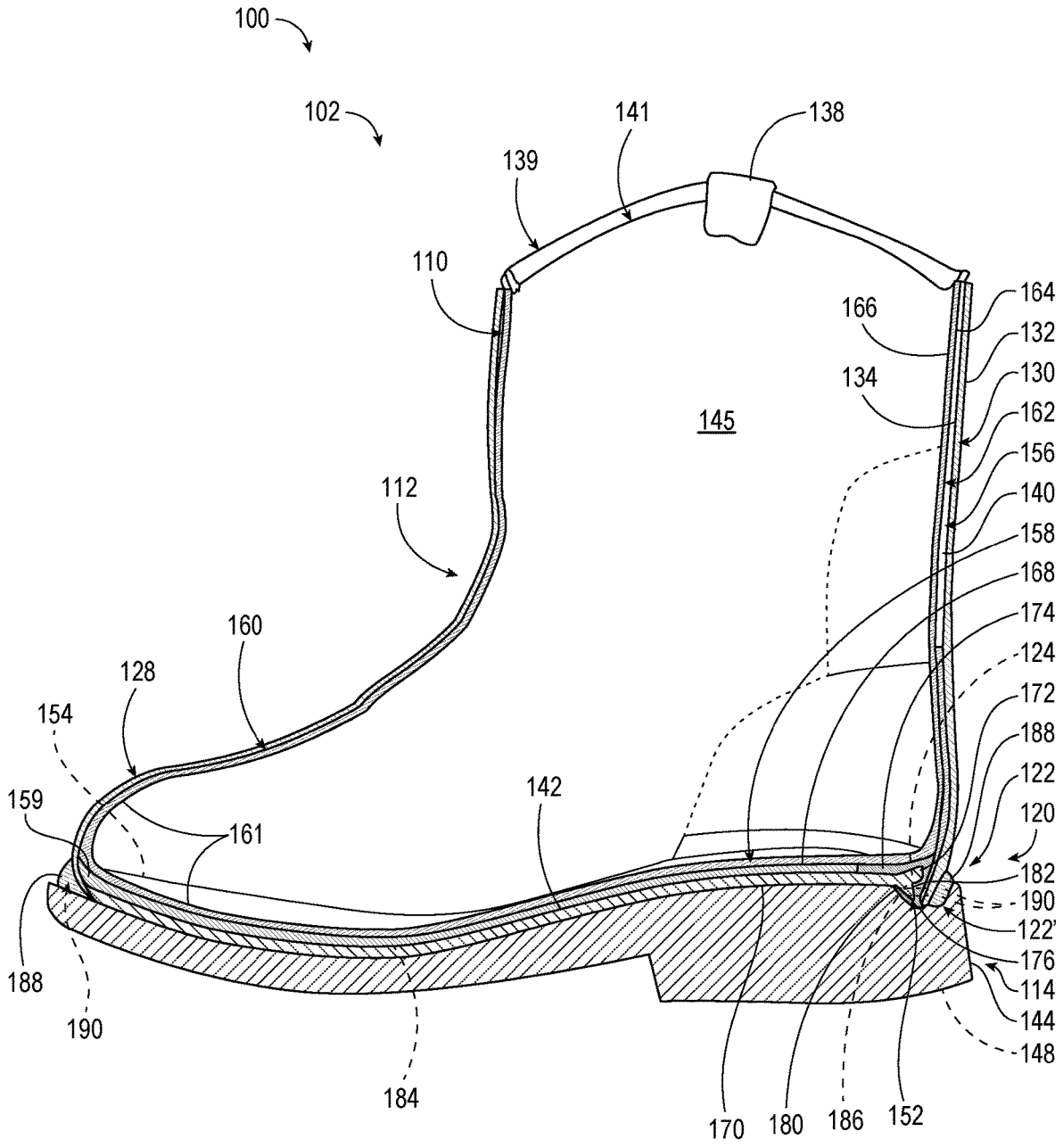
FIG. 10 is a sectional cut-away view of the footwear and bootie securement system of FIG. 4 along plane 10, depicting an example of an anchor tab of the bootie securement system wrapped around and secured to the insole by the one or more fixing elements.
Figure 11:
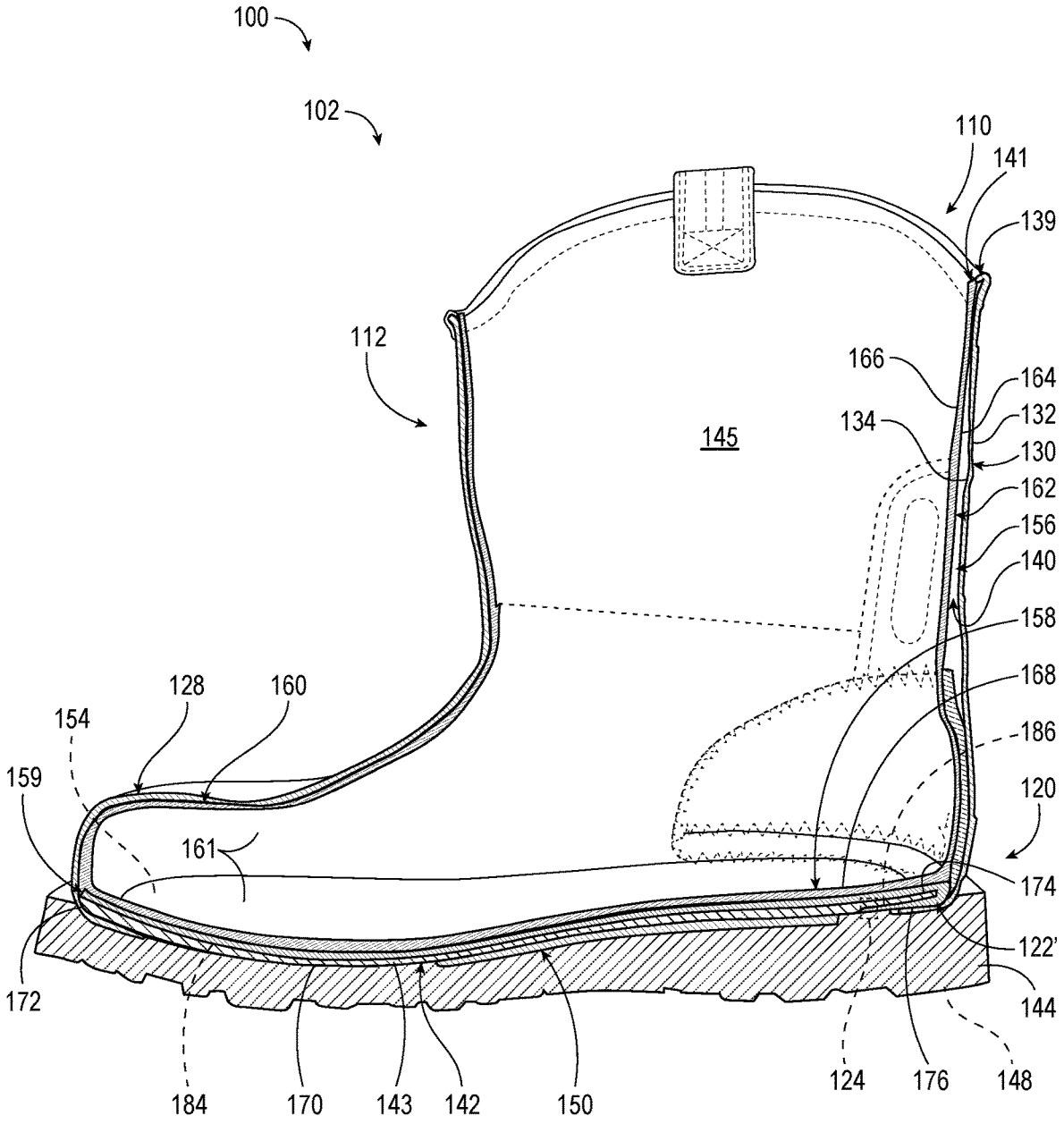
FIG. 11 is a sectional cut-away view of the footwear and bootie securement system of FIG. 4 along plane 11, depicting an example of an anchor tab of the bootie securement system wrapped around and secured to the insole by one or more layers of adhesive.
Figure 12:
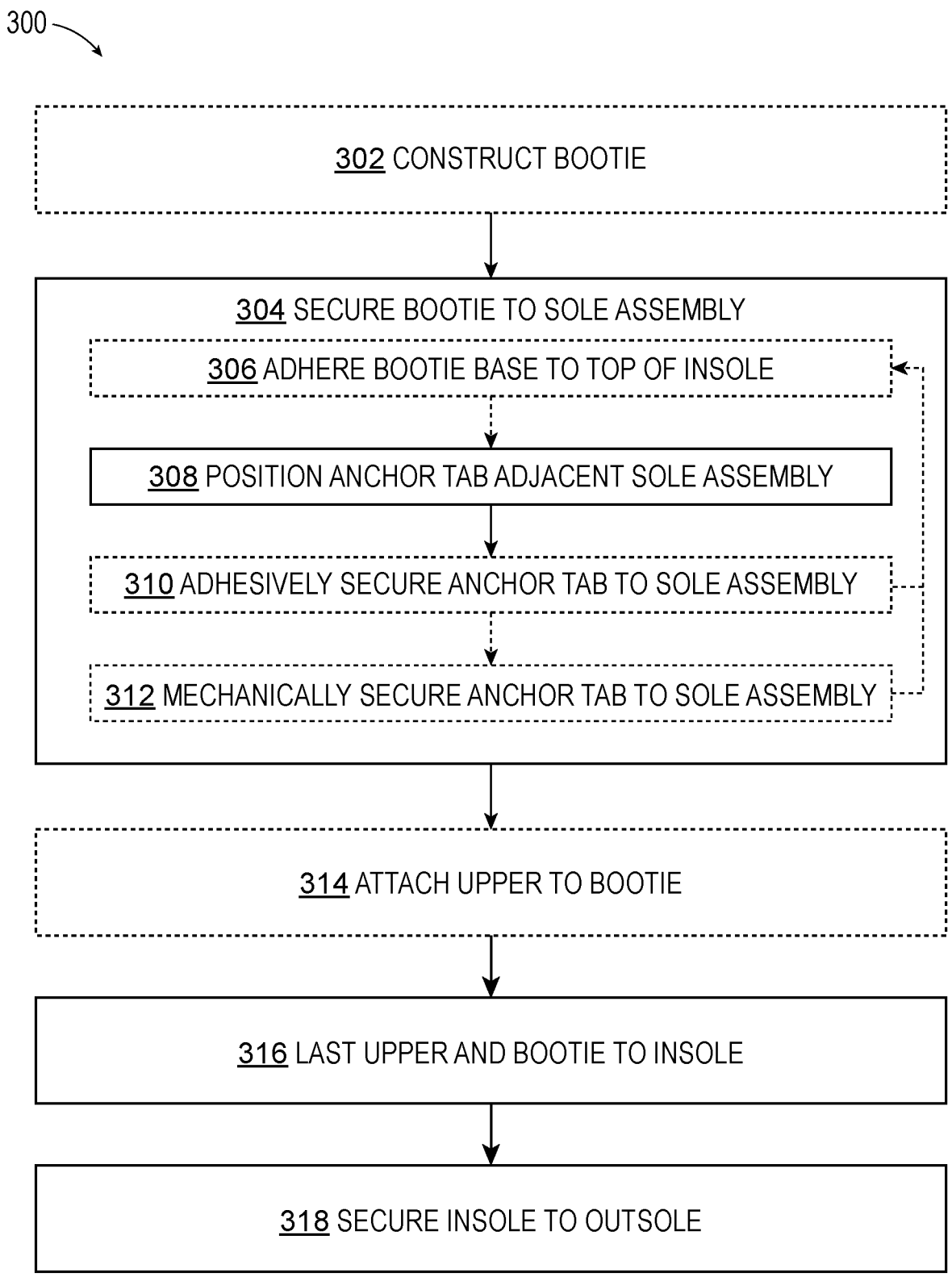
FIG. 12 is a flowchart schematically representing examples of methods for manufacturing footwear according to aspects of the present disclosure.

FIGS. 1-5 schematically illustrate examples of footwear 100 that include bootie securement system 120 according to aspects of the present disclosure, while FIGS. 6-11 illustrate more specific examples of footwear 100 and/or portions thereof according to the present disclosure, and FIG. 12 illustrates examples of methods for manufacturing footwear according to the present disclosure.

As illustrated in FIG. 1, footwear 100 includes a bootie 110, an upper 112 disposed over the bootie 110, and a sole assembly 114 secured to the upper 112 and the bootie 110. Bootie 110 is, or defines, a self-contained enclosure 145 configured to receive the wearer's foot such that the wearer's foot is enclosed by the bootie when the footwear is worn by the wearer. Bootie 110, in turn, is enclosed in a footwear compartment, or chamber, 140 defined by the footwear's upper and sole assembly. Thus, unlike a liner or footbed that only are configured to engage a specific subregion of the wearer's foot, bootie 110 receives and encloses at least a substantial portion, and optionally the entirety, of the wearer's foot when the footwear is worn. When bootie 110 is a waterproof bootie 110, the bootie thus keeps the wearer's foot dry when footwear 100 is worn by the wearer.

Bootie 110 may be referred to as an integrated bootie 110 because it is secured within footwear 100, such as to and between upper 112 and sole assembly 114, with the bootie not configured to be selectively removed from and replaced into the footwear. Instead, at least a portion of the footwear must be destroyed or damaged to remove the bootie from the footwear. Bootie 110 is secured to sole assembly 114 by the bootie securement system 120. Bootie securement system 120 includes one or more anchor tabs 122 extending from bootie 110 and secured to the sole assembly. As discussed in more detail herein, bootie securement system 120 further may include one or more fixing elements 124 that mechanically secure the one or more anchor tabs to the sole assembly 114, and/or a reinforcement adhesive 186 that adhesively secures the one or more anchor tabs to the sole assembly 114.

Footwear 100 is configured to be worn, or donned, by a wearer by receiving and supporting the wearer's foot. As such, footwear 100 may be described as including regions that correspond with specific portions/regions of the wearer's foot when the footwear is donned, such as by being configured to receive and support corresponding portions of the wearer's foot when the footwear is donned. A typical wearer's foot includes a forefoot region (i.e., the front portion of the foot including the toes), a midfoot region (i.e., the middle portion of the foot including the arch of the foot), and a hindfoot region (i.e., the rear portion of the foot including the heel), with the midfoot region disposed between the forefoot region and the hindfoot region to connect the regions together. Accordingly, footwear 100 may be described as including a toe region 104 that is configured to receive and support the forefoot region of the wearer's foot when the footwear is donned, an arch region 106 that is configured to receive and support the midfoot of the wearer's foot when the footwear is donned, and a heel region 108 that is configured to receive and support the hindfoot region of the wearer's foot when the footwear is donned.

Footwear 100 may be any type of shoe 101 or boot 102 that includes an integrated bootie, such as bootie 110. Footwear 100 additionally or alternatively may be referred to as article 100 of footwear and/or footwear article 100. Examples of shoe 101 include a hiking shoe, a snow shoe, an athletic shoe, and a sneaker. Examples of boot 102 include a hiking boot, a work boot, a rain boot, a muck boot, a snow boot, a Western horse riding boot, an English riding boot, and a cowboy boot.

As described in more detail herein, footwear 100 (including its upper 112 and/or sole assembly 114) and/or bootie 110 may be constructed to be waterproof, such as by being constructed from one or more waterproof materials and/or by containing a waterproof coating. In such examples, footwear 100 may be referred to as waterproof footwear 100, upper 112 may be referred to as waterproof upper 112, sole assembly 114 may be referred to as waterproof sole assembly 114, shoe 101 may be referred to as waterproof shoe 101, boot 102 may be referred to as waterproof boot 102, and bootie 110 may be referred to as waterproof bootie 110. As used herein, "waterproof" may include the corresponding element being impervious to water, but it also includes elements that generally are configured or constructed to repel and/or not absorb water and which conventionally may be referred to as being water-resistant.

As schematically illustrated in FIG. 1, upper 112 is secured to sole assembly 114 and extends upwardly from the sole assembly. Upper 112 and sole assembly 114 collectively define a chamber 140 within which bootie 110 is positioned and secured. Upper 112 includes an opening 139 through which the wearer's foot is inserted into chamber 140 and thus into bootie 110 when footwear 100 is donned.

Upper 112 includes a shell 128 that is configured to extend around the upper surfaces of the wearer's foot when footwear 100 is donned by the wearer. Shell 128 may have any shape suitable for extending around at least a substantial portion, if not all, of the upper surfaces of the wearer's foot. Shell 128 is lasted, cemented, or otherwise secured to sole assembly 114 and may be described as extending upwardly away from sole assembly 114.

Upper 112 may further include a shaft 130 that is operatively coupled to shell 128 and configured to extend around at least a portion of a wearer's leg when the footwear is worn by the wearer. Shaft 130 has a bottom end 131 operatively coupled to shell 128 and a top end 133 that forms, or defines, opening 139. In some examples, shell 128 and sole assembly 114 may extend around at least a substantial portion, if not all, of the wearer's foot, while shaft 130 may extend around at least a lower portion of a wearer's leg, such as proximate the Achilles region, above the Achilles region, proximate a mid-calf region, above the mid-calf region, and/or proximate the knee region of the wearer's lower leg. Shaft 130 and shell 128 may be formed from the same or different materials and may be integrally formed or separately formed and subsequently coupled together in upper 112. Upper 112 of footwear 100 in the form of a shoe 101 typically will include a shell but not a shaft, whereas upper 112 of footwear 101 in the form of a boot 102 typically will include a shell and a shaft. This is schematically illustrated with a dash-double-dot line in FIG. 1.

As further illustrated in FIG. 1, upper 112 includes an external surface 132 such that shell 128, and shaft 130 (when present), define the external surface. As used herein, external surface 132 is intended to refer to the surface of the upper 112 that is visible and/or externally accessible while the wearer wears footwear 100. Upper 112 further includes an interior surface 134 arranged opposite external surface 132 and adjacent an exterior side 164 of bootie 110.

Upper 112, including shell 128 and/or shaft 130 (when present), may include one or more sizing mechanisms 136 configured to enable a wearer to selectively adjust the fit of upper 112 to the wearer's foot. In some examples, the one or more sizing mechanisms 136 include one or more adjustable mechanical fasteners 137 configured to enable a wearer to selectively and repeatably adjust a size of footwear compartment 140 by selectively constraining or reducing the size of upper 112 and/or of compartment 140 defined thereby. Examples of such mechanical fasteners 137 include laces, zippers, snaps, buckles, and hook-and-loop fasteners. Upper 112, including shell 128 and/or shaft 130 (when present), alternatively may not include (i.e., are free from) one or more sizing mechanisms 136. In such examples, upper 112 similarly may be free from apertures or other openings (apart from opening 139) through which water or other liquids may pass through the upper.

In some examples, upper 112 further includes one or more pull straps 138 disposed on the upper and configured to facilitate a wearer's donning or doffing of the footwear. The one or more pull straps may be disposed on upper 112 in any suitable arrangement. In some examples, such as when footwear 100 is a boot 102, the one or more pull straps 138 include a pair of pull straps 138 disposed on opposite (such as lateral and medial) sides of upper 112 adjacent opening 139 of shaft 130 and arranged across from one another such that the pair of pull straps 138 are separated from one another by opening 139. In some examples, such as when footwear 100 is a shoe 101, the one or more pull straps 138 may include a single pull strap disposed at a rear of the footwear adjacent opening 139.

Upper 112, including shell 128 and shaft 130 (when present), may be formed from any suitable conventional materials for footwear, with examples including natural or synthetic leather, rubber, canvas, textile, plastic, non-woven, non-wicking, and/or polymeric materials. In some examples, upper 112 is formed from a waterproof or water-resistant material and/or a material that includes a hydrophobic or water-repelling coating.

Sole assembly 114 is operatively coupled to bootie 110 and upper 112. Sole assembly 114 is configured to support the sole of the wearer's foot and to contact a ground surface on which the wearer is striding when footwear 100 is donned by the wearer. Sole assembly 114 additionally or alternatively may be referred to as a sole 114.

Sole assembly 114 may include a variety of components such as those characteristically found in conventional footwear. As schematically illustrated in FIG. 1, sole assembly 114 includes an insole 142 with a top surface 168 that is configured to face the wearer's foot and/or the bootie 110 when footwear 100 is donned by the wearer, and sole assembly 114 further includes an outsole 144 that is configured to contact the ground surface on which the wearer is striding.

Insole 142 is fixedly secured within the footwear and thus is configured not to be removed from footwear 100 without requiring destruction or damage to the footwear. In addition to top surface 168, insole 142 includes a bottom surface 170 arranged opposite top surface 168 and facing outsole 144, and an outer perimeter 172 that connects or extends between top surface 168 and bottom surface 170. Insole 142 may comprise any type of insole construction suitable for use in waterproof footwear. In some examples, insole 142 comprises a lasting board 143. In some examples, insole 142 further comprises a circumferential rib 152 (shown in FIG. 3) protruding from the bottom surface 170 of the insole. As used herein, circumferential rib 152 also may be referred to as protruding rib 152, circumferential protruding rib 152, and/or rib 152. As used herein, an element that is described as protruding from another element additionally or alternatively may be described as extending or projecting from the other element.

Sole assembly 114 further may include a midsole 146 disposed at least partially, and optionally fully, between the insole 142 and the outsole 144. Midsole 146 may be formed from any material suitable for adding support, cushioning, stability, and/or other features to sole assembly 114. Like insole 142, midsole 146 (when present) is fixedly secured to footwear 100, such as by being fixedly secured to insole 142 and/or outsole 144.

Outsole 144 is disposed under insole 142 and/or midsole 146 and provides one or more additional properties to sole assembly 114 such as traction, durability, protection, and support. For example, outsole 144 may be formed from a material or have a shape that increases the durability of sole assembly 114. Additionally, or alternatively, outsole 144 may include a tread pattern to provide or increase the traction that footwear 100 has on the ground surface. Outsole 144 may be made from any suitable material and/or have any suitable shape for providing a wearer with surface traction or other features when footwear 100 is worn by the wearer.

Sole assembly 114 further may include a heel assembly 148 that is configured to be positioned under the heel of the wearer's foot when the footwear is worn by the wearer. Heel assembly 148 may be an external heel assembly that is operatively coupled to and/or projects generally downward from a posterior end of the outsole 144 and/or sole assembly 114. However, this is not required of all examples of sole assembly 114, and it is additionally within the scope of the present disclosure that outsole 144 at least partially or completely defines heel assembly 148. In such examples, heel assembly 148 may be described as an integrated heel assembly. As used herein, heel assembly 148 also may be referred to as heel 148.

Sole assembly 114 further may include a shank 150 that reinforces at least an arch region of the sole assembly 114. Shank 150 may be stiffer and/or more rigid than a remainder of sole assembly 114 and configured to increase a rigidity of at least a portion of the sole assembly.

Footwear 100 further may include a footbed 154 disposed within bootie 110 above the bootie base 158 and configured to contact the bottom of the wearer's foot when the footwear is worn by the wearer. Footbed 154 is configured to be selectively inserted and removed from the bootie 110 and footwear 100 without causing damage to bootie 110, footbed 154, or footwear 100.

Examples of footwear uppers, footwear sole assemblies, and constructions and components thereof are disclosed in U.S. Pat. Nos. 5,720,117, 6,497,057, 7,380,353, 7,752,773, 9,021,721, 9,282,781, 9,578,920, 9,814,280, and in U.S. Patent Application Publication No. 2022/0273075, the complete disclosures of which are incorporated by reference.

As used herein, positional terms such as "top," "above," "bottom," "below," "forward," "rearward," and the like generally refer to a configuration of footwear 100 in which sole assembly 114 rests upon a level horizontal ground surface such that shaft 130 of upper 112 extends vertically upward. In this manner, bootie 110 may be described as being positioned above sole assembly 114, and upper 112 may be described as being positioned above bootie 110 and sole assembly 114. Additionally, a portion of footwear 100 that is configured to receive the toes of the wearer's foot may be described as being positioned forward of a portion of footwear 100 configured to receive the heel of the wearer's foot. However, such positional terms are not limiting, and it is additionally within the scope of the present disclosure that footwear 100 may have any appropriate orientation relative to a level ground surface, and/or that a forward direction may be defined in a suitable manner.

As used herein, the terms "medial," "central," "lateral," "anterior," "posterior," and similar terms are used to describe spatial relationships between components of footwear 100 and are considered from the perspective of the footwear when worn by the wearer standing upright on a level ground surface. Accordingly, a medial surface or medial side, refers to a surface or side of a component that is proximal a midline of the wearer's body, while a lateral surface, or lateral side, refers to a surface or side of a component that is distal the midline of the wearer's body relative to a medial surface or side. Similarly, an anterior surface, anterior end, or anterior side refers to a surface, end, or side of a component that is proximal a toe of a wearer relative to the heel of the wearer, whereas a posterior surface, posterior end, or posterior side refers to a surface, end, or side of a component that is proximal the heel of the wearer relative to the toe of the wearer. The respective "sides" additionally or alternatively may be referred to as ends and/or edges.

As schematically depicted in FIG. 1, bootie 110 is disposed within chamber 140 of footwear 100 and is configured to receive the wearer's foot when footwear 100 is worn by the wearer. Bootie 110 is arranged to extend between the wearer's foot and upper 112, and between the wearer's foot and sole assembly 114. Bootie upper 156 includes an exterior side 164 arranged to face and/or be in contact with the interior surface 134 of upper 112, and an interior side 166 arranged opposite exterior side 164, with the interior side 166 of bootie upper 156 configured to contact the wearer's foot when footwear 100 is worn by the wearer. In some examples, bootie 110 is configured to at least substantially enclose a wearer's foot such that bootie 110 may resemble a sock and thus may be described as having a sock-like shape.

As used herein, elements that are described as being arranged relative to other elements additionally or alternatively may be described as being oriented, being positioned, and/or being secured relative to the other elements. As used herein, descriptions of one or more components of footwear 100 as engaging and/or contacting a body part of the wearer (e.g., a foot, a leg, etc.) also may be understood as referring to a configuration and/or circumstance when the component engages and/or contacts an article of clothing or other covering associated with the body part, such as a sock, a leg of a pair of pants, etc.

Figure 2:
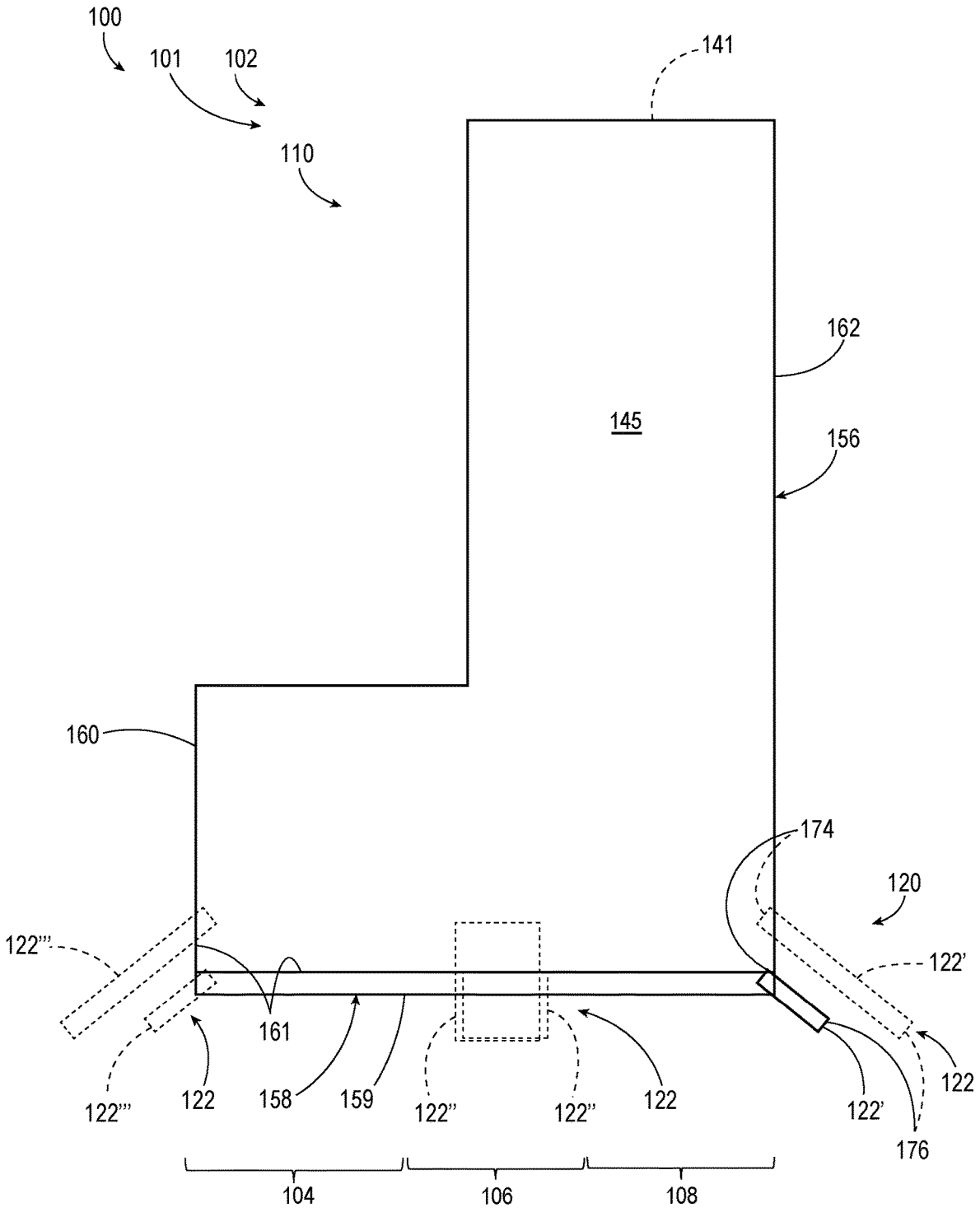
FIG. 2 is a schematic side elevation view illustrating examples of the bootie of FIG. 1.

FIGS. 1-2 schematically illustrate bootie 110 including a bootie upper 156 and a bootie base 158 coupled to the bootie upper to define an enclosure 145 sized to receive and support a wearer's foot within footwear chamber 140 when footwear 100 is donned. Bootie upper 156 may have any shape that corresponds to the shape of interior surface 134 of upper 112 and is configured to receive a wearer's foot. Bootie 110 includes a bootie opening 141 through which the wearer's foot is inserted into the bootie when footwear 100 is donned.

Similar to upper 112 of footwear 100, bootie upper 156 includes a foot portion 160 configured to at least substantially enclose a top and sides of the wearer's foot. In some examples, including when footwear 100 is a boot 102, bootie upper 156 also includes a leg portion 162 configured to extend around at least a lower portion of a wearer's leg, such as proximate the Achilles region, above the Achilles region, proximate a mid-calf region, above the mid-calf region, and/or proximate the knee region of the wearer's lower leg when footwear 100 is donned by the wearer.

Bootie base 158 may be coupled to bootie upper 156 along a bottom of foot portion 160 to close off and form enclosure 145 such that bootie 110 fully encloses the wearer's foot when footwear 100 is worn by the wearer. Bootie base 158 is configured to extend around a bottom, and optionally the bottom and the sides of the wearer's foot, such that by coupling bootie base 158 to the bootie upper 156, bootie 110 at least substantially encloses the wearer's foot. Bootie base 158 may be coupled to the bootie upper by any suitable mechanism and/or construction, including adhesives, stitching, and/or integrally forming at least portions of the bootie base with bootie upper 156. When bootie 110 is a waterproof bootie 110, the bootie upper and bootie base may be formed from waterproof or water-resistant materials, such as non-woven materials, and/or may be coated with a water-repelling, or water-repellant, coating. Furthermore, seams and/or other regions where two or more portions of the bootie are secured together may be covered or coated with a waterproof layer of material, tape, etc.

Figure 3:
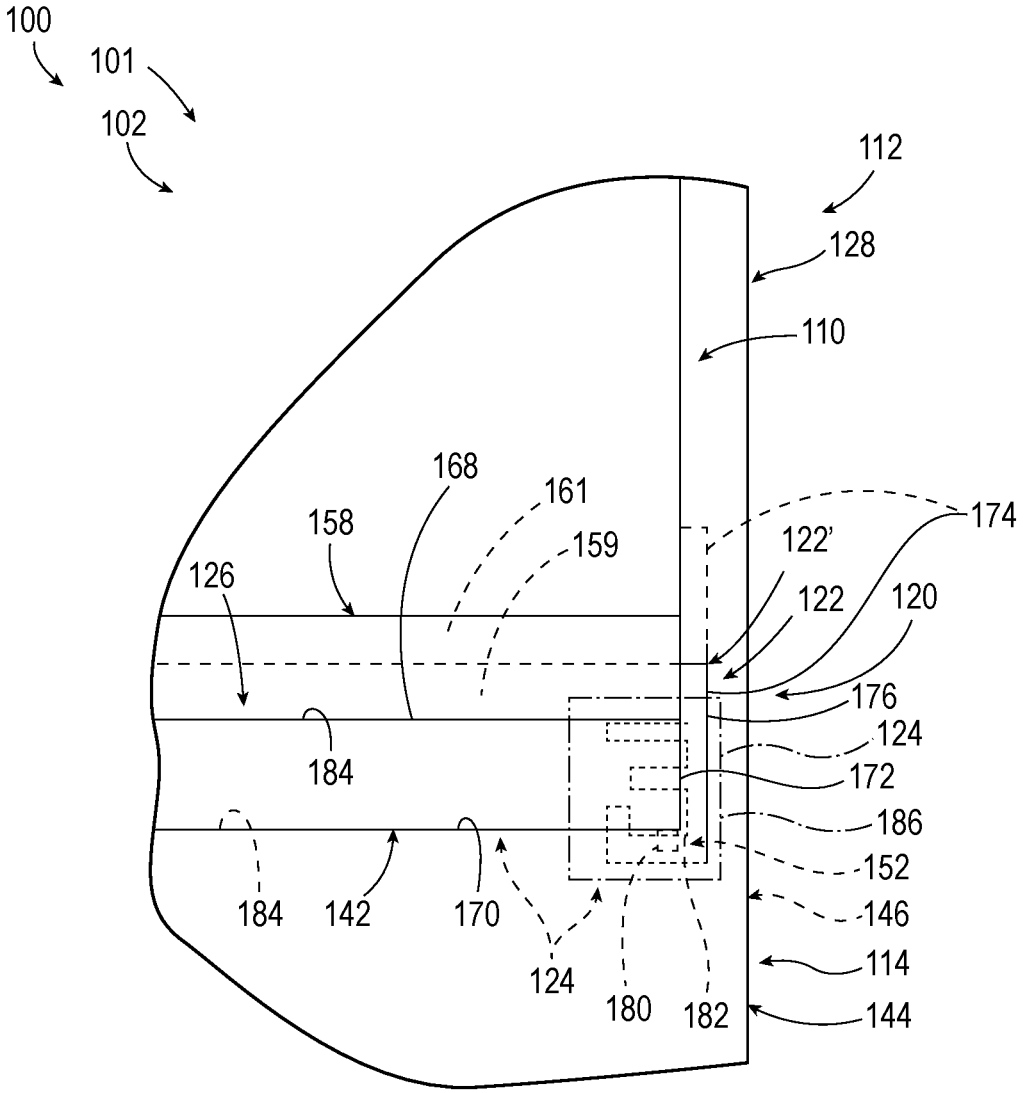
FIG. 3 is a schematic fragmentary detail of a portion of the footwear of FIG. 1.

As schematically illustrated in FIGS. 1 and 3 collectively, bootie base 158 may include a layer 161 of material that is coupled to bootie upper 156 to form enclosure 145. Layer 161 may be formed from the same material or materials from which bootie upper 156 is formed, and layer 161 optionally may be thicker, more durable, and/or more or less resilient than the material(s) forming bootie upper 156. At least a portion, and optionally all, of layer 161 may be integrally formed with bootie upper 156. As also schematically illustrated in FIGS. 1-3, bootie base 158 also may include a waterproof gasket 159 that is secured beneath layer 161 and/or which extends around layer 161 to form a liquid barrier between sole assembly 114 and bootie upper 156. Such liquid barrier may be resistant to permeation or penetration by water, such as by being hydrophobic, liquid impermeable, etc.

As schematically illustrated in FIG. 2, bootie 110, like footwear 100, may be described as including three regions: a toe region 104 configured to receive the forefoot portion of the wearer's foot, an arch region 106 configured to receive a midfoot region of the wearer's foot, and a heel region 108 configured to receive a hindfoot region of the wearer's foot.

As discussed, footwear 100 further includes a bootie securement system 120 that secures bootie 110 to sole assembly 114. As used herein, bootie securement system 120 additionally or alternatively may be referred to as bootie anchor system 120 and/or bootie attachment system 120. As illustrated in FIG. 2, bootie securement system 120 includes one or more anchor tabs 122 that extend from bootie 110 and are configured to be secured to sole assembly 114, such as schematically illustrated in FIGS. 1 and 3. As used herein, elements that are described as being present in quantities of "one or more" additionally or alternatively may be described as "at least one" of such elements, with examples including a single such element, a plurality of such elements, two of such elements, three of such elements, four of such elements, and more than four of such elements. As examples, the one or more anchor tabs 122 may include a single anchor tab, two anchor tabs, three anchor tabs, four anchor tabs, or more than four anchor tabs.

As schematically illustrated in FIG. 2, the one or more anchor tabs may extend from any portion of the bootie, such as bootie upper 156, bootie base 158, layer 161, waterproof gasket 159, and from any region of such portions, such as toe region 104, arch region 106, and/or heel region 108. In some examples, bootie securement system 120 will include at least one anchor tab 122, such as a heel anchor tab 122', extending from heel region 108 of bootie upper 156, bootie base 158, layer 161, and/or waterproof gasket 159. In some examples, bootie securement system 120 additionally or alternatively will include at least one anchor tab, such an arch anchor tab 122", extending from arch region 106 of bootie upper 156, bootie base 158, layer 161, and/or waterproof gasket 159. When bootie 110 includes at least one arch anchor tab 122', it may include at least one arch anchor tab 122" extending from the lateral and/or medial sides of the arch region of the bootie. In some examples, bootie securement system 120 additionally or alternatively will include at least one anchor tab, such as a toe anchor tab 122''', extending from toe region 104 of bootie upper 156, bootie base 158, layer 161, and/or waterproof gasket 159.

The one or more anchor tabs 122 may be formed from the same material as bootie upper 156 and/or bootie base 158 (including layer 161 and/or waterproof gasket 159), or any other suitable material. In some examples, the one or more anchor tabs 122 are formed from a high strength material such as nylon, polyester, etc. Additionally, or alternatively, the one or more anchor tabs 122 may be formed from a resilient durable material.

The one or more anchor tabs 122 may be fixedly secured to or integrally formed with bootie 110. The one or more anchor tabs 122 may extend away from the exterior side of bootie 110 in any direction prior to assembly of footwear 100, with the one or more anchor tabs 122 being wrapped or otherwise arranged to extend against, at least partially around, into, and/or under a portion of sole assembly 114 and subsequently secured thereat or thereto, as schematically illustrated in FIGS. 1 and 3. Examples of suitable portions of sole assembly 114 to which the one or more anchor tabs are secured include insole 142 and midsole 146 (when present), with more specific examples including top surface 168 of insole 142, bottom surface 170 of insole 142, outer perimeter 172 of insole 142, interior side 180 of rib 152 of insole 142 (shown, exterior side 182 of rib 152 of insole 142, a top surface of midsole 146, and a perimeter of midsole 146. In some examples, the one or more anchor tabs 122 may extend between insole 142 and midsole 146 and/or between insole 142 and outsole 144 in the assembled footwear.

As illustrated in FIG. 2 in connection with heel anchor tab 122', each of the one or more anchor tabs 122 may include a base portion 174 disposed on bootie 110 and a projecting tab 176 extending away from base portion 174. The relative dimensions of base portion 174 and projecting tab 176 may vary, provided that the base portion provides a sufficient region of attachment to the bootie and the projecting tab is sufficiently long to extend from the bootie to the portion of the sole assembly to which the anchor tab is secured.

Base portion 174 of the one or more anchor tabs 122 may be fixedly coupled to or integrally formed with bootie upper 156 or bootie base 158 such that projecting tab 176 extends away from base portion 174 and bootie 110. In examples where one or more anchor tabs 122 are fixedly coupled to bootie 110, base portion 174 of the one or more anchor tabs 122 may be mechanically or adhesively secured to the bootie upper 156 or the bootie base 158. In examples where one or more anchor tabs 122 are integrally formed with bootie 110, base portion 174 of the one or more anchor tabs 122 may be integrally formed with the bootie upper 156 or the bootie base 158. When the one or more anchor tabs are integrally formed with bootie base 156, they may be integrally formed with layer 161 or waterproof gasket 159. The one or more anchor tabs 122 may be arranged on bootie 110 such that the projecting tab(s) 176 extend out and away from bootie 110.

As schematically illustrated in FIG. 3, bootie securement system 120 further includes one or more fixing elements 124 that mechanically secure the one or more anchor tabs to the sole assembly and/or the reinforcement adhesive 186 that adhesively secures the one or more anchor tabs to the sole assembly, such as to any of the portions of sole assembly 114 described above. The one or more fixing elements 124 may include one or a plurality of stitches, staples, screws, nails, and/or any other connector suitable for forming a cold connection to mechanically secure bootie 110 to insole 142. Footwear 100 may further include one or more adhesive layers 126, which may include a plurality of adhesive layers, that adhesively secure one or more components of bootie 110 to insole 142. In some examples, one or more adhesive layer 126 includes a primary adhesive layer 184 for adhesively securing the bootie base 158 to the top surface 168 of insole 142. The one or more adhesive layers 126 additionally or alternatively may be referred to as an adhesive 126, an adhesive layer 126, and/or a layer of adhesive 126.

In some examples, projecting tab 176 of the one or more anchor tabs 122 is wrapped around a portion of the outer perimeter 172 of insole 142 and secured to bottom surface 170 of the insole 142 by one or more fixing elements 124 and/or reinforcement adhesive 186, such that the insole is disposed at least partially between a bottom surface of bootie base 158 and the projecting tab 176 of one or more anchor tabs 122.

In some examples, the projecting tab 176 of the one or more anchor tabs 122 is folded under the bottom surface of bootie base 158 and secured to the top surface 168 of insole 142 by one or more fixing elements 124 and/or reinforcement adhesive 186, such that projecting tab 176 is disposed between bootie base 158 and insole 142.

In some examples, the projecting tab 176 of the one or more anchor tabs 122 extends partially down the outer perimeter 172 of insole 142 and is secured thereat by one or more fixing elements 124 and/or reinforcement adhesive 186, such that projecting tab 176 is disposed between the outer perimeter 172 of insole 142 and upper 112.

In some examples, the projecting tab 176 of the one or more anchor tabs 122 is folded such that it protrudes into the insole 142 and is secured thereat by one or more fixing elements 124 and/or reinforcement adhesive 186, such that an end of projecting tab 176 is disposed within insole 142.

In some examples, insole 142 includes circumferential rib 152 protruding from the bottom surface 170 of the insole, and the projecting tab 176 of the one or more anchor tabs 122 is wrapped over the outer perimeter 172 of insole 142, around the circumferential rib 152 and secured to an interior side 180 of the circumferential rib 152 by one or more fixing elements 124 and/or reinforcement adhesive 186.

In some examples, insole 142 includes circumferential rib 152, and the projecting tab 176 of the one or more anchor tabs 122 is folded down such that the tab extends over the outer perimeter 172 of insole 142, extends at least partially down an exterior side 182 of circumferential rib 152, and is secured to the exterior side 182 of the circumferential rib 152 by one or more fixing elements 124 and/or reinforcement adhesive 186.

Each of these examples is schematically illustrated in FIG. 3, with less schematic versions described and/or illustrated subsequently.

As schematically represented in FIG. 1, bootie base 158 is arranged above the top surface 168 of insole 142 and may be adhesively secured to top surface 168 by the primary adhesive layer 184 of the one or more adhesive layers 126.

Upper 112 may be lasted to sole assembly 114 using any suitable method, such as cementing, Blake welting, and/or Goodyear welting. Regardless of the lasting method, upper 112 is lasted to sole assembly 114 of footwear 100 over bootie 110, which is already secured to insole 142, such that the one or more anchor tabs 122 of bootie securement system 120 that are secured to insole 142 are at least partially disposed between the lasted upper 112 and the portion of sole assembly 114 to which they are secured.

In some examples, upper 112 is lasted to sole assembly 114 using a Goodyear welt method, such that footwear 100 further comprises a welt 188 and one or more welt couplings 190. As schematically illustrated in FIG. 1, footwear 100 may further include welt 188 disposed around a perimeter of insole 142 and attached to insole 142 by the one or more welt couplings 190. The one or more welt couplings 190 may include a first welt coupling 190 that penetrates the welt substantially horizontally and a second welt coupling 190 that penetrates the welt substantially vertically. The first welt coupling may penetrate through welt 188, upper 112, and insole 142 to couple the welt to the insole, while the second welt coupling may penetrate substantially vertically through welt 188 and sole assembly 114 to couple a combined bootie 110—upper 112—insole 142—welt 188 structure of footwear 100 to the remainder of sole assembly 114. As used herein, the upper 112 attached to the bootie 110 and insole 142 may be considered a combined bootie-upper-insole structure. As used herein, the combined bootie-upper-insole structure with the addition of welt 188 may be referred to as a combined bootie-upper-insole-welt structure. In some examples, the first welt coupling may further penetrate through the projecting tab 176 of the one or more anchor tabs 122 secured to insole 142. As such, in specific regions of footwear 100 at which the one or more anchor tabs are disposed, the first welt coupling 190 penetrates through welt 188, upper 112, projecting tab 176, and insole 142 to couple the combined bootie-upper-insole structure to welt 188.

In some examples, and as discussed in more detail in connection with FIG. 7, upper 112 is lasted to sole assembly 114 using a cementing method. In such examples, insole 142 includes lasting board 143, and securing bootie 110 to insole 142 includes wrapping projecting tab 176 of the one or more anchor tabs 122 around the lasting board, securing the projecting tab(s) 176 to an underside of the lasting board using one or more fixing elements 124 and/or the reinforcement adhesive 186, and lasting the upper 112 to the lasting board over bootie 110. Upper 112 is lasted to lasting board 143 over bootie 110 by pulling a bottom portion of upper 112 around the outer perimeter 172 of the lasting board and securing the bottom portion of upper 112 to the bottom side 170 of the lasting board over the projecting tabs 176 using an adhesive cement. The lasting board is further cemented to the sole assembly to create an example of footwear 100.

To further illustrate suitable constructions for footwear 100, bootie 110, and bootie securement system 120 according to the present disclosure, FIGS. 4-11 depict examples of footwear 100 in the form of a boot 102 and corresponding booties 110 and bootie securement systems 120. The booties and bootie securement systems illustrated and described in connection with FIGS. 6-11 may be utilized with any of the other styles of footwear described and/or schematically illustrated herein, including shoes 101.

Figure 4:
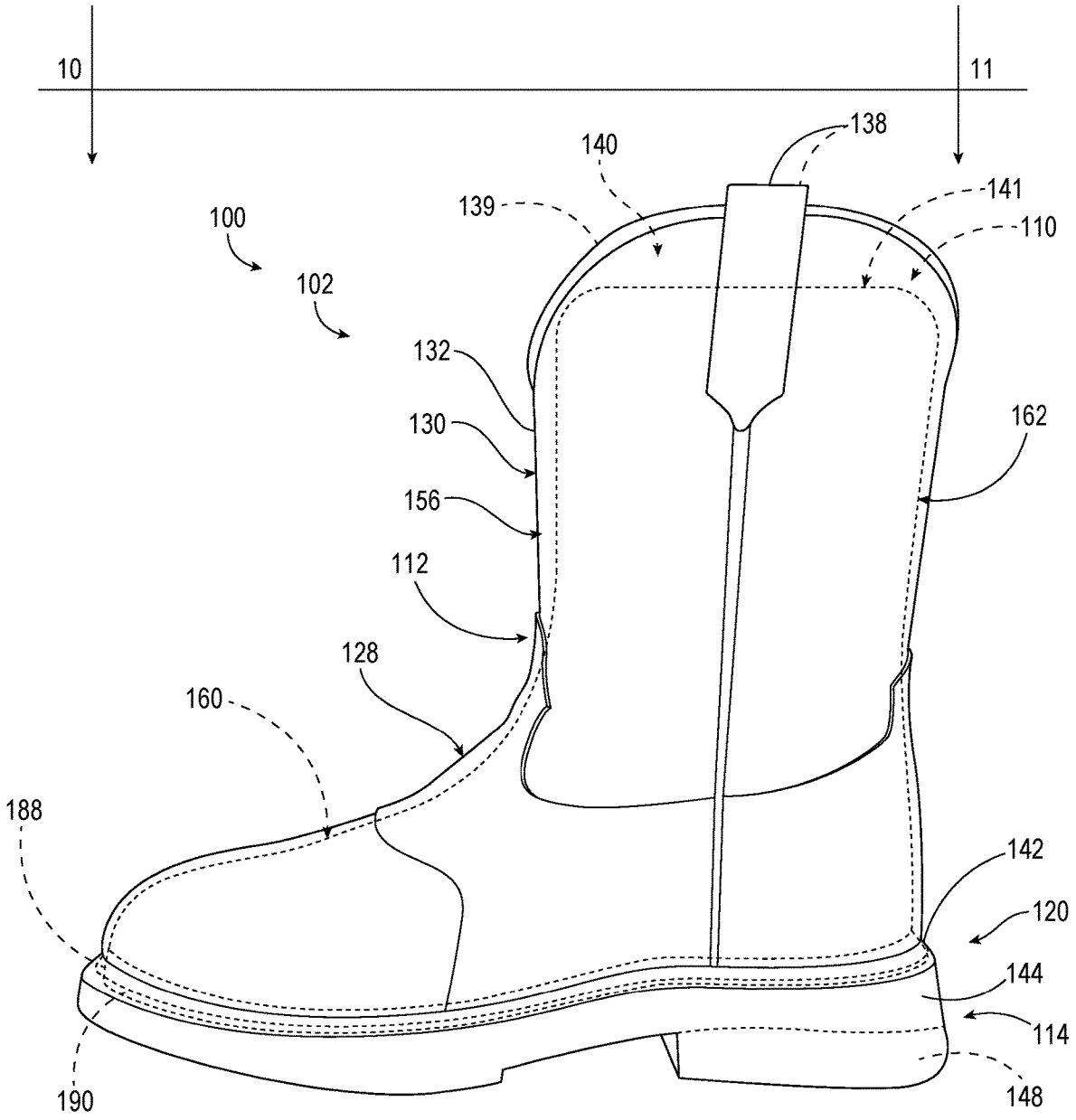
FIG. 4 is a side elevation view of a footwear according to aspects of the present disclosure.
Figure 5:
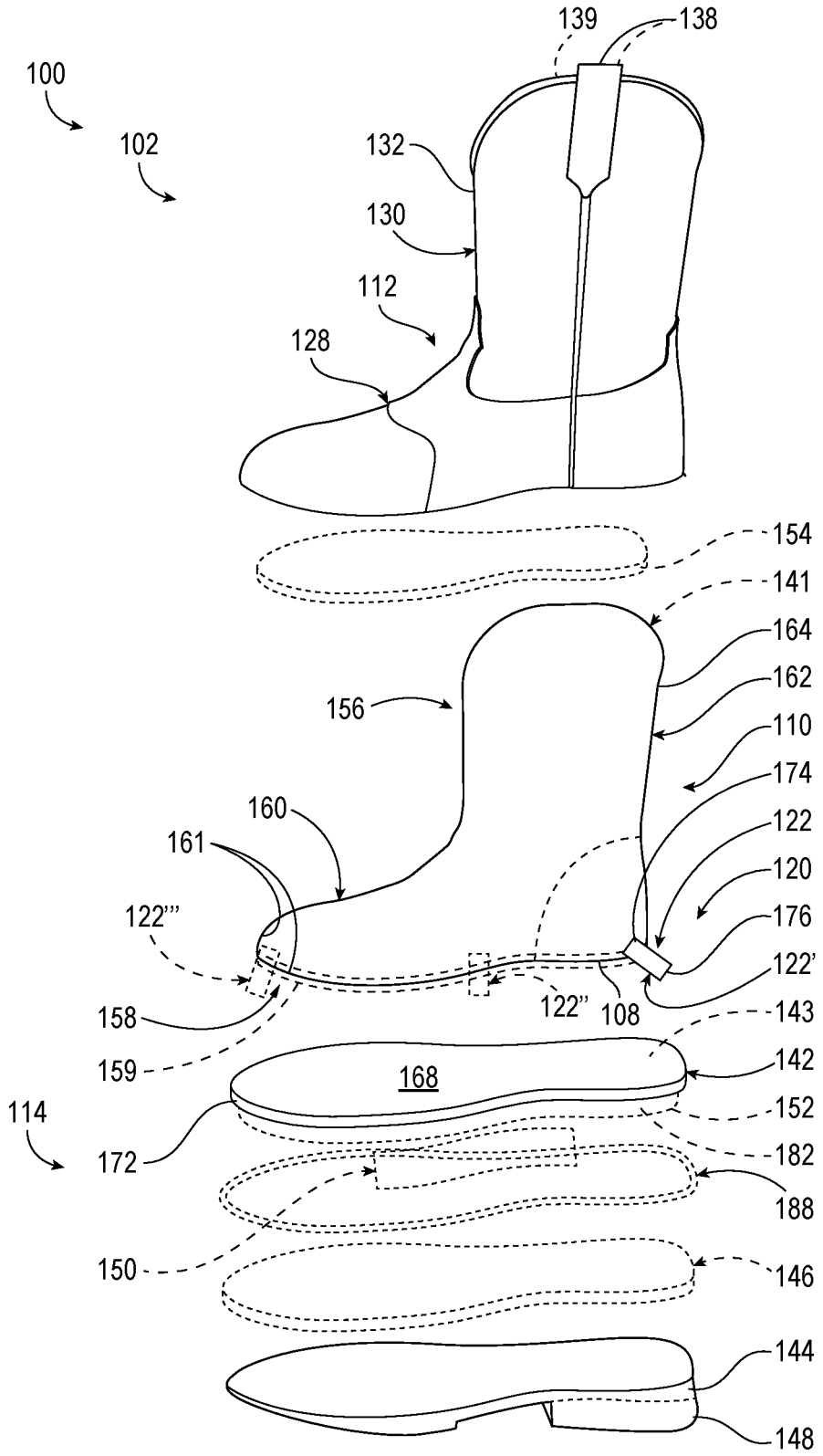
FIG. 5 is an exploded side elevation view of the footwear of FIG. 4 illustrating example components of the footwear and the relative relationships between the example components according to the present disclosure.

FIG. 4 illustrates an example of a boot 102, such as in the form of a pull-on boot 102 that is free from external sizing mechanisms configured to enable a wearer to selectively adjust the fit of upper 112 to the wearer's foot. FIG. 5 is an exploded view of boot 102 of FIG. 4 and illustrates examples of the relative relationships, or arrangements, of the components of the boot. As schematically illustrated in FIGS. 4-5, boot 102 includes an upper 112 that includes a shell 128 and a shaft 130, an opening 139, a pair of pull straps 138, and a sole assembly 114 that includes at least an insole 142, an outsole 144, and a heel 148. As illustrated in dashed lines in FIG. 4, boot 102 further includes bootie 110 disposed within chamber 140 of upper 112 and secured to sole assembly 114. Boot 102 may further include a welt 188 and one or more welt couplings 190 for attaching bootie 110, insole 142, and upper 112 lasted over bootie 110 and onto insole 142 to the remainder of sole assembly 114. Welt 188 may be arranged around the perimeter of boot 102 adjacent the outer perimeter of insole 142 and at least a bottom section of upper 112 and secured to the insole thereat by the one or more welt couplings 190 that penetrate through at least the welt 188, the upper 112, and the insole 142.

Bootie 110 depicted in FIG. 5 is an example bootie 110 having at least a heel anchor tab 122' extending from heel region 108 of bootie 110. Footbed 154 is arranged within bootie 110 such that the footbed is spaced from insole 142 by the bootie base 158, the footbed being configured to contact the wearer's foot when boot 102 is worn by the wearer. In some examples, example boot 102 depicted in FIG. 5 may be constructed using a Goodyear welt construction and as such further includes welt 188 to be disposed around and secured to the outer perimeter of insole 142. In some examples, example boot 102 depicted in FIG. 5 may be constructed using a cementing method. Midsole 146 may be disposed between and coupled to insole 142 and outsole 144.

Figure 6:
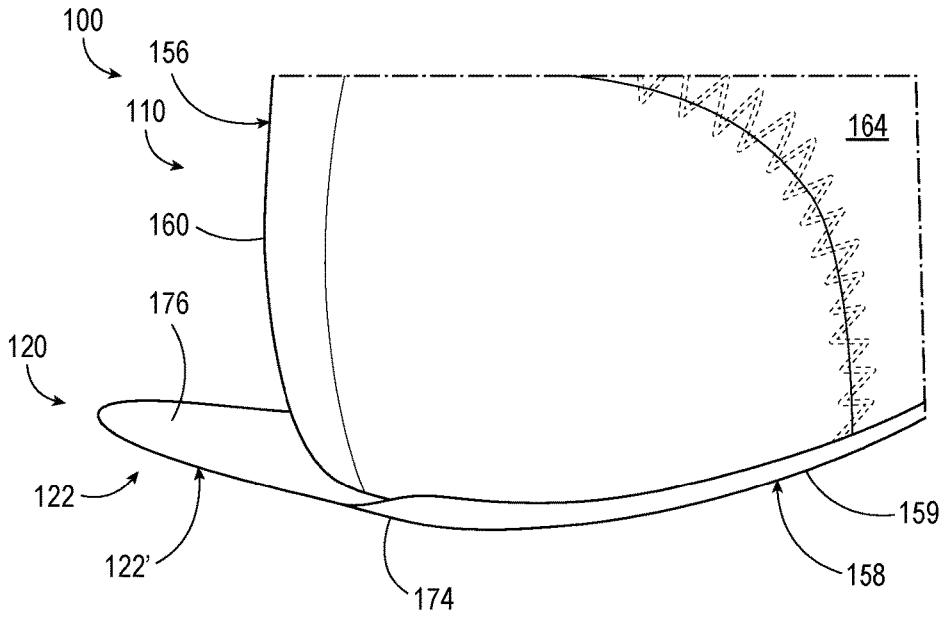
FIG. 6 is a rear top isometric view of a section of a bootie of FIG. 6 according to aspects of the present disclosure.

As illustrated schematically in FIGS. 1-3 and less schematically in FIG. 6, base portion 174 of the one or more anchor tabs 122 and/or heel anchor tab 122' may be integrally formed with bootie base 158 of bootie 110 such that protruding tab 176 of the one or more anchor tabs 122 and/or heel anchor tab 122' is formed with bootie base 158 and projects, protrudes, or otherwise extends outwards from bootie base 158 away from bootie 110.

Figure 7:
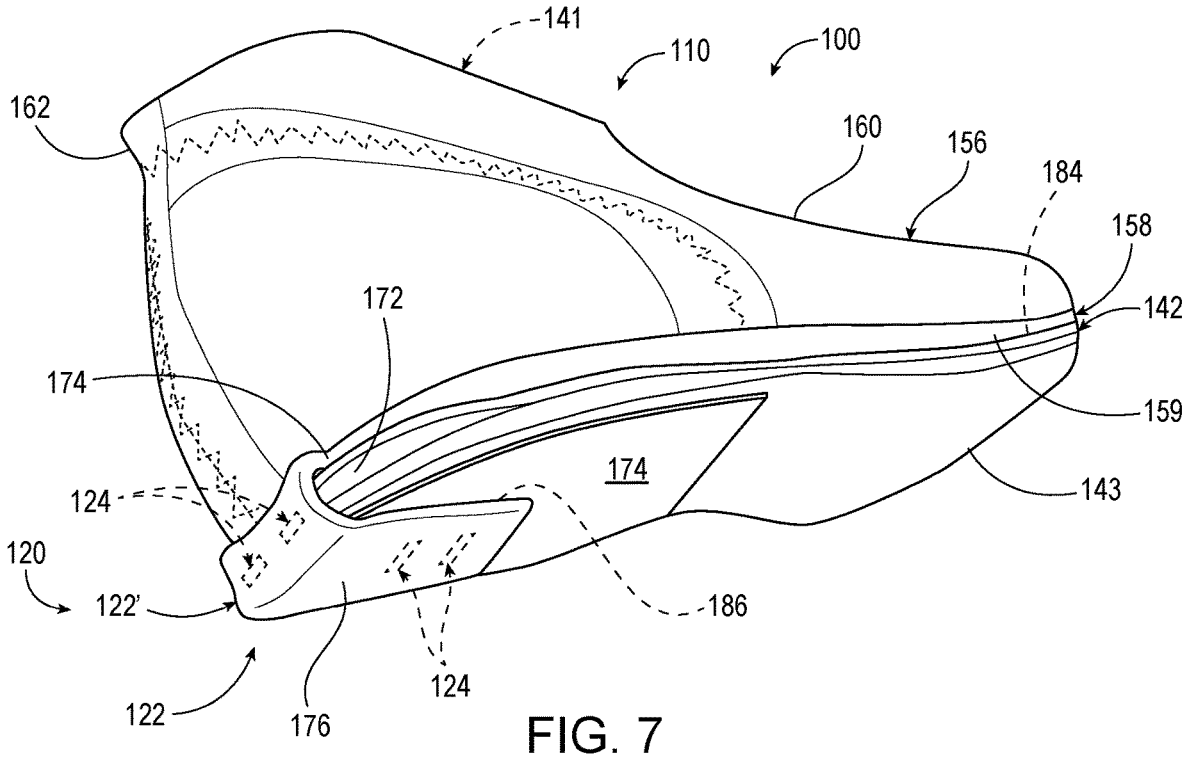
FIG. 7 is a bottom isometric view depicting a bootie adhesively secured to an insole according to aspects of the present disclosure.

As illustrated schematically in FIG. 1 and less schematically in the example of FIG. 7, insole 142 includes a lasting board 143, and projecting tab 176 of the one or more anchor tabs 122 is adhesively secured to bottom surface 170 of insole 142 within heel region 108. As shown in the example of FIG. 7, projecting tab 176 of the one or more anchor tabs 122 extends from bootie 110 and wraps around outer perimeter 172 and bottom surface 170 of insole 142, such that projecting tab 176 is disposed under bottom surface 170 of insole 142 and adhesively secured thereat by at least reinforcement adhesive layer 186 of bootie securement system 120. As illustrated in dashed lines in FIG. 7, projecting tab 176 additionally or alternatively may be mechanically secured to bottom surface 170 and/or outer perimeter 172 of insole 142 by one or more fixing elements 124.

Figure 8:
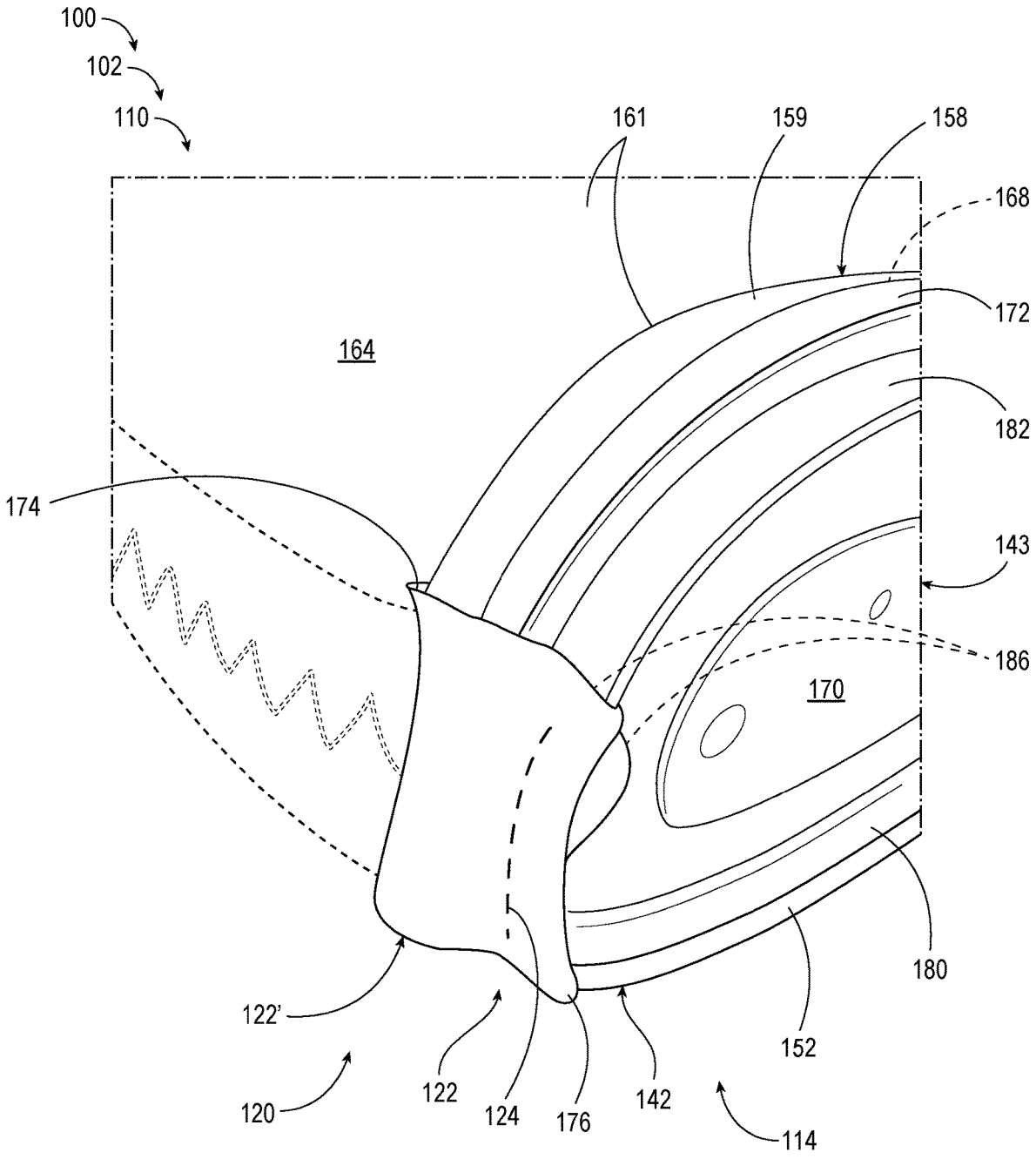
FIG. 8 is a rear bottom isometric view of a bootie mechanically secured to a circumferential protruding rib of the insole by one or more fixing elements according to the present disclosure.
Figure 9:
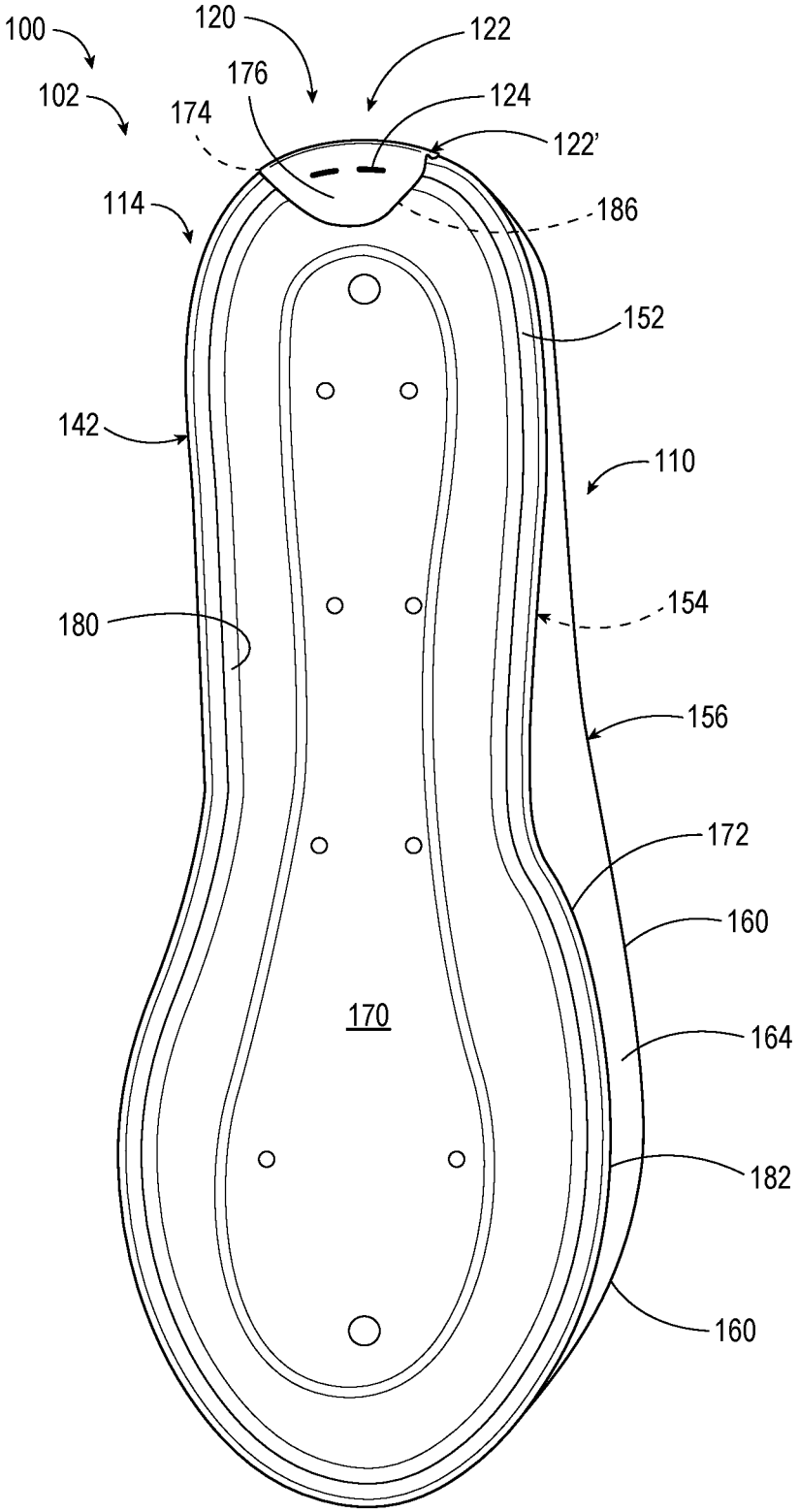
FIG. 9 is a bottom plan view of a bootie mechanically secured to a bottom surface of the insole by one or more fixing elements according to the present disclosure.

As illustrated schematically in FIG. 1 and less schematically in the example of FIGS. 8-9, insole 142 further includes circumferential rib 152, and projecting tab 176 of the one or more anchor tabs 122 is mechanically secured to insole 142 and/or protruding rib 152 of the insole by one or more fixing elements 124. Projecting tab 176 of the one or more anchor tabs 122 may be mechanically secured to interior side 180 of protruding rib 152 and/or exterior side 182 of protruding rib 152 by the one or more fixing elements 124. Additionally or alternatively, projecting tab 176 of the one or more anchor tabs 122 may be adhesively secured to interior side 180 of protruding rib 152 and/or exterior side 182 of protruding rib 152 by the reinforcement adhesive 186.

As depicted in the example of FIG. 8, the projecting tab 176 of the one or more anchor tabs 122 is wrapped around circumferential rib 152 and secured to the interior side 180 of the protruding rib by one or more fixing elements 124. Additionally, or alternatively, as depicted in the example of FIG. 8 the projecting tab 176 of the one or more anchor tabs 122 may be wrapped around the protruding rib 152 and secured to the bottom surface 170 of insole 142 by the one or more fixing elements 124. The projecting tab 176 of the one or more anchor tabs 122 may additionally, or alternatively, be adhesively secured to the bottom surface 170 of insole 142 and/or protruding rib 152 by the reinforcement adhesive 186 of the bootie securement system 120.

FIG. 10 is a cross-sectional view of FIG. 4 along plane 10. As illustrated schematically in FIGS. 1-3 and less schematically in FIG. 10, projecting tab 176 of the one or more anchor tabs 122 extends from waterproof gasket 159 and is wrapped around circumferential protruding rib 152 and secured thereat by the one or more fixing elements 124, such that at least a portion of projecting tab 176 is disposed between insole 142 and another portion of the sole assembly, such as the midsole 146 and/or outsole 144. Additionally or alternatively, projecting tab 176 may wrap around circumferential protruding rib 152 and be adhesively secured thereat by reinforcement adhesive 186. Furthermore, as depicted in FIG. 10, projecting tab 176 is wrapped around circumferential protruding rib 152 such that at least a portion of projecting tab 176 is disposed below the foot of the wearer when boot 102 is worn. Footbed 154 may be placed within bootie 110 and optionally attached to bootie base 158 within the bootie such that in at least heel region 108 of boot 102, footbed 154 is arranged over bootie base 158, insole 142, and at least a portion of projecting tab 176 of heel anchor tab 122.

Welt 188 is attached to the insole of the combined bootie-upper-insole structure by first welt coupling 190 of the one or more welt couplings 190 that protrudes substantially horizontally through welt 188, and at least a portion of upper 112, projecting tab 176 of heel anchor tab 122', and circumferential protruding rib 152. As used herein, the combined bootie-upper-insole structure with the addition of welt 188 may be considered a combined bootie-upper-insole-welt structure. Due to the wrapped arrangement of projecting tab 176 of heel anchor 122' around the circumferential protruding rib 152, first welt coupling 190 protrudes twice through projecting tab 176, sandwiching protruding rib 152 between portions of projecting tab 176. Specifically, the first welt coupling 190 penetrates through a portion of the projecting tab 176 disposed on exterior side 182 of protruding rib 152 and then penetrates through a portion of the projecting tab 176 disposed on the internal side 180 of protruding rib 152.

The combined bootie-upper-insole-welt structure is attached to outsole 144 and/or a remainder of sole assembly 114 by the second welt couplings 190 of the one or more welt couplings 190 that protrudes substantially vertically through welt 188 of the combined bootie-upper-insole-welt structure, midsole 146, outsole 144, and/or heel assembly 148 of sole assembly 114. As such, the combined bootie-upper-insole-welt structure is secured to the remaining sole assembly 114 by the second welt coupling 192 to form boot 102.

FIG. 11 is a cross-sectional view of FIG. 4 along plane 11. As illustrated schematically in FIG. 1 and less schematically in FIG. 11, insole 142 includes lasting board 143, and projecting tab 176 of the one or more anchor tabs 122 extends from gasket 159 and is wrapped around the outer perimeter 172 of insole 142 and adhesively secured to the bottom surface 170 of insole 142 by reinforcement adhesive layer 186 of bootie securement system 120. Additionally, or alternatively, projecting tab 176 may be mechanically secured to the bottom surface 170 of insole 142 by one or more fixing elements 124.

This section describes steps of illustrative methods 300 for manufacturing footwear in which a bootie is secured to a sole assembly of the footwear using a bootie securement system. Aspects of footwear 100, bootie 110, and bootie securement systems 120 described and illustrated herein may be utilized in the method steps described below. Where appropriate, reference may be made to components and systems that may be used in carrying out each step. These references are for illustration and are not intended to limit the possible ways of carrying out any particular step of the method.

FIG. 12 is a flowchart illustrating steps performed in illustrative examples of methods 300 for manufacturing footwear that includes a bootie and a bootie securement system. Additional components of such footwear include an upper disposed over the bootie and a sole assembly secured to the upper and the bootie, with the sole assembly including an insole, a midsole, and/or an outsole. Methods 300 may be used to construct any of the footwear 100 described, illustrated, and/or incorporated herein. In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As shown, methods 300 include constructing the bootie at optional step 302, securing the bootie to the sole assembly of the footwear at step 304, attaching the upper to the bootie at optional step 314, lasting the upper to the bootie and insole at step 316, and securing the insole attached to the upper and the bootie to the outsole at step 318. Methods 300 further include one or more sub-steps of step 304. Step 304 of securing the bootie to the sole assembly of the footwear may include the sub-steps of adhering the bootie base of the bootie to a top of the insole at optional step 306, positioning an anchor tab of the one or more anchor tabs adjacent the sole assembly at step 308, adhesively securing the anchor tab to the sole assembly at optional step 310, and/or mechanically securing the anchor tab to the sole assembly at optional step 312.

The optional step 302 of constructing the bootie may include cutting out the bootie upper and the bootie bottom from one or more pieces of material, and attaching the bootie bottom to the bootie upper to form the bootie. In some examples, this step may include cutting out a single shape from the material that represents an integrated bootie upper and bootie bottom and stitching or otherwise attaching the ends of the integral bootie upper and bootie bottom to itself to form the bootie. In some examples, step 302 further includes forming a waterproof gasket for the bootie and adhering or otherwise securing the waterproof gasket to the material of the bootie bottom. In some examples, this step may include cutting out a bootie upper having one or more integrally formed anchor tabs, cutting out a bootie bottom having one or more integrally formed anchor tabs, and/or cutting out or otherwise forming a bootie gasket having one or more integrally formed anchor tabs. Additionally or alternatively, step 302 may include fixedly attaching one or more anchor tabs to the bootie. The one or more anchor tabs may be fixedly attached to the bootie upper and the bootie base. When the one or more anchor tabs are fixed attached to the bootie base, they may be fixedly attached to the material of the bootie base and/or to the waterproof gasket. In some examples, step 302 further includes applying a waterproof sealant and/or waterproof tape to the seams of the bootie formed at the junctions between the bootie upper and the bootie base, or the connecting junction of the integrally formed bootie upper and bootie base.

Securing at step 304 the formed bootie to the sole assembly of footwear 100 may include one or more sub-steps (i.e., step 306, step 308, step 310, and/or step 312) depending on insole type and/or the type of footwear construction used. The formed bootie may be secured to one or more portions of the sole assembly, such as discussed herein.

Examples of suitable portions of the sole assembly to which the one or more anchor tabs may be secured to secure the bootie to the sole assembly include the insole and the midsole (when present), with more specific examples including a top surface of the insole, a bottom surface of the insole, an outer perimeter of the insole, an interior side of a rib of the insole, an exterior side of the rib of the insole, a top surface of the midsole, and a perimeter of the midsole. The bootie is disposed within footwear 100 and secured to one or more portions of the sole assembly by the bootie securement system, which includes the one or more anchor tabs, one or more fixing elements, and/or a reinforcement adhesive. The insole may comprise any suitable type of insole construction such as a ribbed insole or a lasting board.

The optional step 306 of adhering the bootie base to the insole may include orientating the bootie and the sole assembly in the same direction, arranging the bootie over the insole such that the bootie base is disposed in contact with the top surface of the insole, applying a primary adhesive layer to a bottom surface of the bootie base and/or the top surface of the insole, and pressing the bootie base to the insole to adhesively secure the bootie to the insole. Step 306 may be completed prior to positioning the anchor tab adjacent to the sole assembly at step 308 or alternatively may be performed after adhesively securing and/or mechanically securing the anchor tab to the sole assembly at optional step 310 and/or step 312. For example, in cases where the anchor tab is secured to a bottom side or outer perimeter of the insole, the bootie base may be adhered to the top of the insole prior to positioning the anchor tab adjacent the insole and adhering and/or securing the anchor tab thereat. However, in cases where the anchor tab is also secured to the top of the insole, adhering the bootie base to the top of the insole may be performed after adhering and/or mechanically securing the anchor tab to the insole.

Positioning at step 308 the anchor tab of the one or more anchor tabs adjacent one or more locations on the sole assembly may include manipulating the projecting tab of the anchor tab extending from the bootie such that the projecting tab is disposed adjacent a selected portion of the sole assembly. Examples of suitable portions of sole assembly 114 adjacent to which the one or more anchor tabs may be disposed include the insole and the midsole (when present), with more specific examples including the top surface of the insole, the bottom surface of the insole, the outer perimeter of the insole, the interior side of the rib of the insole, the exterior side of the rib of the insole, the top surface of the midsole, and the perimeter of the midsole. In some examples, the one or more anchor tabs may extend between the insole and the midsole and/or between the insole and the outsole in the assembled footwear.

In some examples, positioning the anchor tab at step 308 adjacent the sole assembly includes folding the projecting tab of the one or more anchor tabs under the bottom surface of the bootie base, such that the projecting tab is disposed adjacent the top surface of the insole and arranged at least partially between the bootie base and the insole. In some examples, positioning the anchor tab at step 308 adjacent the sole assembly includes manipulating the projecting tab of the one or more anchor tabs such that the projecting tab extends partially down and is positioned adjacent the outer perimeter of the insole. In some examples, positioning the anchor tab at step 308 adjacent the sole assembly includes wrapping the projecting tab of the one or more anchor tabs around the outer perimeter of the insole and under the bottom surface of the insole, such that the insole is disposed at least partially between the bottom surface of the bootie base and the projecting tab of the one or more anchor tabs. In some examples, the insole includes a recess disposed in the outer perimeter of the insole and positioning the anchor tab at step 308 adjacent the sole assembly includes manipulating the projecting tab of the one or more anchor tabs such that the projecting tab extends partially down the outer perimeter of the insole and folds into the recess of the insole. In some examples, the insole comprises a circumferential rib protruding from the bottom surface of the insole and positioning the anchor tab at step 308 adjacent the sole assembly includes wrapping the projecting tab of the one or more anchor tabs around the circumferential protruding rib. The projecting tab may be partially or fully wrapped around the circumferential protruding rib.

The projecting tab of the anchor tab optionally may be adhesively secured at step 310 and/or mechanically secured at step 312 to the sole assembly. The optional step 310 of adhesively securing the anchor tab to the sole assembly may include applying a reinforcement adhesive of the bootie securement system to the projecting tab and/or to the sole assembly at the chosen location, and pressing the projecting tab to the sole assembly at the chosen location to adhesively secure the projecting tab to the sole assembly. The reinforcement adhesive may comprise any suitable adhesive.

Additionally or alternatively, the anchor tab may be mechanically secured at optional step 312 to the sole assembly using one or more fixing elements. The one or more fixing elements may include a plurality of stitches, staples, screws, nails, and/or any other suitable connector suitable for forming a cold connection to mechanically secure the bootie to the sole assembly. Optional step 312 may be performed prior to or after the optional step 306 of adhering the bootie base to the top of the insole.

The optional step 314 of attaching the upper to the bootie may include one or more of; applying an adhesive between the bootie upper and the footwear upper, pressing the footwear upper and the bootie upper together to adhere the uppers to one another, and/or sewing the bootie to the upper in one or more spots. In some examples, the bootie upper is sewn to the footwear upper in a toe region of the bootie and footwear.

Lasting the upper to the insole over the bootie at step 316 may include pulling the combined upper-bootie-insole structure over a last (i.e., a physical form shaped like a human foot) such that the insole is positioned along a sole of the last, pulling or stretching the bottom ends of the footwear upper down and around at least a portion of the bottom surface of the insole, and securing bottom ends of the footwear upper to the bottom surface of the insole. The bottom ends of the footwear upper may be secured to the bottom side of the insole using one or more mechanical fixings and/or an adhesive.

Securing the insole to the outsole at step 318 includes one or more steps depending on the type of securement used to attach the insole to the outsole. Examples of securement types used to attach the insole to the outsole include cementing, Blake welting, and/or Goodyear welting. Securing the insole and thus the upper and bootie to the outsole may include the use of an adhesive layer or cement, one or more welt couplings, and/or one or more sole stitches.

In some examples, securing the insole to the outsole at step 318 includes applying cement to the bottom of the insole and/or to a top of the outsole and/or sole assembly and pressing the insole to the outsole to secure the combined upper-bootie-insole structure to the outsole.

In some examples, the insole includes a circumferential rib protruding from the bottom surface of the insole and securing the insole of the combined upper-bootie-insole structure to the outsole at step 318 includes using a Goodyear welt. Accordingly, step 318 may include arranging a welt around a periphery of the insole, attaching the welt to the insole, and securing the combined upper-bootie-insole-welt structure to the outsole and/or a remaining portion of the sole assembly. Attaching the welt to the insole may include horizontally penetrating the welt, the upper, the anchor tab, the circumferential rib, and/or the bottom of the insole using first welt couplings of the one or more welt couplings to attach the welt to the insole. As such in cases where the projecting tab of the anchor tab is wrapped around the circumferential rib of the insole, the first welt couplings in anchor tab locations horizontally penetrate through the welt, the upper, a proximal portion of the projecting tab, the ribbed insole, and a distal portion of the projecting tab in one pass.

Securing the combined upper-bootie-insole-welt structure to the outsole and/or the remaining portion of the sole assembly at step 318 may further include applying adhesive to the welt and/or the top surface of the outsole and/or the remaining portion of the sole assembly, and/or vertically penetrating the welt, midsole, and/or outsole using second welt couplings of the one or more welt couplings to mechanically secure the combined upper-bootie-insole-welt structure to the outsole and/or the remaining portion of the sole assembly and form footwear 100.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entities in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" may mean A alone, B alone, C alone, A and B together, A and C together, B and C together, A, B, and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

As used herein, "at least substantially," when modifying a degree or relationship, may include not only the recited "substantial" degree or relationship, but also the full extent of the recited degree or relationship. A substantial amount of a recited degree or relationship may include at least 75% of the recited degree or relationship. For example, an object that is at least substantially formed from a material includes objects for which at least 75% of the objects are formed from the material and also includes objects that are completely formed from the material. As another example, a first length that is at least substantially as long as a second length includes first lengths that are within 75% of the second length and also includes first lengths that are as long as the second length.

Illustrative, non-exclusive examples of footwear, booties, bootie securement systems, and methods according to the present disclosure are presented in the following enumerated paragraphs. It is within the scope of the present disclosure that an individual step of a method recited herein, including in the following enumerated paragraphs, may additionally or alternatively be referred to as a "step for" performing the recited action.

A0. An article of footwear, comprising:

a bootie configured to receive and enclose a wearer's foot when the footwear is worn by the wearer, wherein the bootie includes a bootie upper and a bootie base coupled to the bootie upper;

an upper disposed over the bootie upper;

a sole assembly secured to the upper and the bootie, the sole assembly comprising at least an insole and an outsole; and a bootie securement system for securing the bootie to one or more portions of the sole assembly, the bootie securement system including at least one anchor tab that extends from the bootie and is secured to the sole assembly to secure the bootie to the insole.

A1. The article of footwear of paragraph A0, wherein the bootie securement system is configured to prevent detachment of the bootie from the sole assembly during doffing and donning of the article of footwear.

A1.1. The article of footwear of any of paragraphs A0-A1, wherein the bootie securement system is configured to prevent detachment of the bootie from the insole of the sole assembly during doffing and donning of the article of footwear.

A2. The article of footwear of any of paragraphs A0-A1.1, wherein the bootie is a self-contained enclosure for the wearer's foot.

A2.1. The article of footwear of any of paragraphs A0-A2, wherein the bootie is sock-shaped and includes a foot portion configured to enclose an entirety of a wearer's foot and a shaft portion extending away from the foot portion and configured to enclose at least a portion of a wearer's leg that is proximate the wearer's foot.

A2.2. The article of footwear of any of paragraphs A0-A2.1, wherein the bootie extends around at least a heel, a sole, and a toe of a wearer's foot.

A2.3. The article of footwear of any of paragraphs A0-A2.2, wherein the bootie is fully assembled prior to being secured to the sole assembly.

A2.4. The article of footwear of any of paragraphs A0-A2.3, wherein the bootie is formed from a waterproof material.

A2.5. The article of footwear of any of paragraphs A0-A2.4, wherein the bootie base includes a waterproof gasket.

A2.5.1. The article of footwear of paragraph A2.5, wherein the waterproof gasket is formed from a non-woven waterproof material.

A2.5.2. The article of footwear of any of paragraphs A2,5-A2.5.1, wherein the at least one anchor tab is formed from the same material as the waterproof gasket.

A2.5.3. The article of footwear of any of paragraphs A2.5-A2.5.2, wherein the at least one anchor tab is integrally formed with the waterproof gasket.

A2.6. The article of footwear of any of paragraphs A0-A2.5.3, wherein the at least one anchor tab comprises a base portion disposed on the bootie and a projecting tab extending away from the base portion.

A3. The article of footwear of any of paragraphs A0-A2.6, wherein the bootie is mechanically secured and/or adhesively secured to the sole assembly by the bootie securement system.

A3.1. The article of footwear of any of paragraphs A0-A3, wherein the bootie securement system further includes one or more fixing elements and the at least one anchor tab is mechanically secured to the sole assembly by the one or more fixing elements.

A3.1.1. The article of footwear of any of paragraphs A2.6, wherein the projecting tab together with the one or more fixing elements form a mechanical coupling that mechanically secures the bootie to the sole assembly.

A3.2. The article of footwear of any of paragraphs A0-A3, wherein the bootie securement system further includes a reinforcement adhesive and the at least one anchor tab is adhesively secured to the sole assembly by the reinforcement adhesive.

A3.3. The article of footwear of any of paragraphs A0-A3, wherein the bootie securement system further includes one or more fixing elements and a reinforcement adhesive, and the at least one anchor tab is mechanically and adhesively secured to the sole assembly by the one or more fixing elements and the reinforcement adhesive.

A3.4. The article of footwear of any of paragraphs A0-A3.3, wherein the at least one anchor tab is fixedly secured to the bootie.

A3.4.1. The article of footwear of any of paragraphs A0-A3.4, wherein the at least one anchor tab is mechanically secured to the bootie upper.

A3.4.2. The article of footwear of any of paragraphs A0-A3.4, wherein the at least one anchor tab is mechanically secured to the bootie base.

A3.5. The article of footwear of any of paragraphs A0-A3.3, wherein the at least one anchor tab is integrally formed with the bootie.

A3.5.1. The article of footwear of paragraph A3.5, wherein the at least one anchor tab is integrally formed with the bootie base.

A3.5.2. The article of footwear of paragraph A3.5, wherein the at least one anchor tab is integrally formed with the bootie upper.

A4. The article of footwear of any of paragraphs A0-A3.5.2, wherein the bootie includes a toe region, an arch region, and a heel region.

A4.1. The article of footwear of paragraph A4, wherein the at least one anchor tab extends outwards from one or more of the toe region, the arch region, and the heel region of the bootie.

A4.1.1. The article of footwear of paragraph A4.1, wherein the at least one anchor tab extends outwards from the heel region of the bootie.

A4.1.2. The article of footwear of any of paragraphs A0-A4.1, wherein the at least one anchor tab extends outwards from the arch region of the bootie.

A4.1.3. The article of footwear of any of paragraphs A0-A4.1, wherein the at least one anchor tab extends outwards from the toe region of the bootie.

A4.2. The article of footwear of any of paragraphs A0-A4.1.3, wherein the at least one anchor tab is formed from the same material as the bootie.

A.4.3. The article of footwear of any of paragraphs A0-A4.2, wherein the at least one anchor tab is formed from the same material as the bootie base.

A4.3.1. The article of footwear of paragraph A4.3, wherein the bootie base includes a waterproof gasket, and wherein the at least one anchor tab is formed from the same material as the waterproof gasket.

A4.4. The article of footwear of any of paragraphs A0-A4.3.1, wherein the at least one anchor tab is formed from a resilient material.

A4.5. The article of footwear of any of paragraphs A0-A4.4, wherein the at least one anchor tab is formed from a high-strength material, and optionally from at least one of nylon, a polyester, and a polymer.

A5. The article of footwear of any of paragraphs A0-A4.5, wherein the insole is fixedly secured to at least one of the upper and the bootie.

A5.1. The article of footwear of any of paragraphs A0-A5, wherein the insole is fixedly secured to the outsole.

A5.1.1. The article of footwear of any of paragraphs A0-A5.1, wherein the sole assembly further comprises a midsole disposed between the insole and the outsole.

A5.1.2. The article of footwear of paragraph A5.1.1, wherein the insole is fixedly secured to the midsole.

A5.2. The article of footwear of any of paragraphs A5.1.1-A5.1.2, wherein the bootie securement system is configured to prevent detachment of the bootie from the midsole of the sole assembly during doffing and donning of the article of footwear.

A5.3. The article of footwear of any of paragraphs A0-A5.2, wherein the at least one anchor tab is secured to the insole, the midsole, and/or the outsole to secure the bootie to the sole assembly.

A6. The article of footwear of any of paragraphs A0-A5.3, wherein the insole has a top surface, a bottom surface opposite the top surface, and an outer perimeter connecting the top surface to the bottom surface.

A6.1. The article of footwear of any of the paragraphs A0-A6, wherein the at least one anchor tab is mechanically secured to the insole by the one or more fixing elements.

A6.1.1. The article of footwear of paragraph A6.1, wherein the at least one anchor tab is mechanically secured to the top surface of the insole by the one or more fixing elements to mechanically secure the bootie to the insole.

A6.1.2. The article of footwear of paragraph A6.1, wherein the projecting tab of the at least one anchor tab is folded under the bootie base and mechanically secured to the top surface of the insole such that at least a portion of the projecting tab of the at least one anchor tab is disposed between the bootie base and the insole.

A6.1.3. The article of footwear of paragraph A6.1, wherein the at least one anchor tab is mechanically secured to at least a portion of the outer perimeter of the insole by the one or more fixing elements to couple the bootie to the insole.

A6.1.3.1. The article of footwear of paragraph A6.1.3, wherein the projecting tab of the at least one anchor tab extends from the base portion and is mechanically secured to a side of the outer perimeter of the insole by the one or more fixing elements.

A6.1.4. The article of footwear of paragraph A6.1, wherein the at least one anchor tab is mechanically secured to the bottom surface of the insole by the one or more fixing elements to mechanically secure the bootie to the insole.

A6.1.4.1. The article of footwear of paragraph A6.1.4, wherein the projecting tab of the at least one anchor tab is wrapped around at least a portion of the insole and mechanically secured to the bottom surface of the insole such that at least a portion of the at least one anchor tab is disposed between the insole and the outsole.

A6.2. The article of footwear of any of paragraphs A6.1-A6.1.4.1, wherein the insole comprises a ribbed insole having a lasting board and a circumferential rib protruding from a bottom surface of the lasting board.

A6.2.1. The article of footwear of paragraph A6.2, wherein the projecting tab of the at least one anchor tab is wrapped around at least a portion of the circumferential rib and fixed thereat by the one or more fixing elements to mechanically secure the bootie to the ribbed insole.

A6.2.2. The article of footwear of any of paragraphs A6.2-A6.2.1, wherein the one or more fixing elements penetrate through the projecting tab of the at least one anchor tab and the circumferential rib to mechanically secure the bootie to the ribbed insole.

A6.2.2.1. The article of footwear of any of paragraphs A6.1-A6.2.2, wherein the one or more fixing elements comprise stitches.

A6.2.2.2. The article of footwear of any of paragraphs A6.1-A6.2.2, wherein the one or more fixing elements comprise staples.

A6.2.3. The article of footwear of any of paragraphs A6.1-A6.2.2.2, wherein the one or more fixing elements form a cold connection between the bootie and the insole.

A6.3. The article of footwear of any of paragraphs A0-A6.2.3, wherein the insole comprises a lasting board having a top surface and a bottom surface opposite the top surface.

A6.3.1. The article of footwear of paragraph A6.3, wherein the at least one anchor tab is wrapped around at least a portion of the lasting board and mechanically secured thereto by the one or more fixing elements, to mechanically secure the bootie to the lasting board.

A6.3.2. The article of footwear of any of paragraphs A6.3-A6.3.1, wherein the one or more fixing elements penetrate through the projecting tab of the at least one anchor tab and through the bottom surface of the lasting board to mechanically secure the bootie to the lasting board.

A6.3.3. The article of footwear of any of paragraphs A6.3.1-A6.3.2, wherein the one or more fixing elements comprise stitches.

A6.3.4. The article of footwear of any of paragraphs A6.3.1-A6.3.2, wherein the one or more fixing elements comprise staples.

A7. The article of footwear of any of paragraphs A6-A6.3.3, further comprising one or more adhesive layers for adhesively securing the bootie to the insole.

A7.1. The article of footwear of paragraph A7, wherein the one or more adhesive layers includes at least a primary adhesive layer.

A7.1.1. The article of footwear of paragraph A7.1, wherein the primary adhesive layer is disposed between at least the bootie base of the bootie and the top surface of the insole to adhesively couple the bootie to the top surface of the insole.

A7.1.1.1. The article of footwear of any of paragraphs A7.1-A7.1.1, wherein the primary adhesive layer between the bootie base and the insole is disposed along at least a portion of a length of the bootie base.

A7.1.2. The article of footwear of any of paragraphs A7.1-A7.1.1.1, wherein the primary adhesive layer is disposed between at least a waterproof gasket of the bootie and the top surface of the insole to adhesively couple the bootie to the top surface of the insole.

A7.1.2.1. The article of footwear of paragraph A7.1.2, wherein the primary adhesive layer between the waterproof gasket and the insole is disposed along at least a portion of a length of the gasket.

A7.2. The article of footwear of any of paragraphs A3.2-A7.1.2.1, wherein the at least one anchor tab is adhesively secured to the insole of the sole assembly by the reinforcement adhesive, to adhesively secure the bootie to the insole.

A7.2.1. The article of footwear of any of paragraphs A3.2-A7.2, wherein the reinforcement adhesive is disposed between a/the projecting tab of the at least one anchor tab and the insole to adhesively secure the at least one anchor tab to the insole.

A7.2.1.1. The article of footwear of any of paragraphs A3.2-A7.2.1, wherein the projecting tab of the at least one anchor tab is adhesively coupled to the top surface of the insole by the reinforcement adhesive.

A7.2.1.2. The article of footwear of any of paragraphs A3.2-A7.2.1.1, wherein the projecting tab of the at least one anchor tab is adhesively coupled to at least a portion of the outer perimeter of the insole by the reinforcement adhesive.

A7.2.1.3. The article of footwear of any of paragraphs A3.2-A7.2.1.2, wherein the projecting tab of the at least one anchor tab is adhesively secured to the bottom surface of the insole by the reinforcement adhesive.

A7.3. The article of footwear of any of paragraphs A3.2-A7.2.1.3, wherein the one or more fixing elements penetrate through the projecting tab of the at least one anchor tab, the reinforcement adhesive, and the insole to adhesively and mechanically secure the bootie to the insole.

A7.4. The article of footwear of any of paragraphs A3.2-A7.3, wherein the at least one anchor tab is adhesively secured to the midsole by the reinforcement adhesive, to adhesively secure the bootie to the sole assembly.

A7.5. The article of footwear of any of paragraphs A3.2-A7.3, wherein the at least one anchor tab is adhesively secured to the outsole by the reinforcement adhesive, to adhesively secure the bootie to the sole assembly.

A8. The article of footwear of any of paragraphs A0-A7.5, further comprising a footbed disposed within the bootie above the bootie base and configured to contact a bottom of the wearer's foot when the footwear is worn by the wearer.

A8.1. The article of footwear of paragraph A8, wherein the footbed is configured to be selectively inserted and removed from the bootie without damage to the bootie or the footbed.

A9. The article of footwear of any of paragraphs A0-A8.1, wherein the sole assembly further comprises a heel assembly disposed under a portion of the outsole and affixed thereat.

A10. The article of footwear of any of paragraphs A0-A9, further comprising a welt that extends around a periphery of the footwear and couples the upper and the bootie to the sole assembly using one or more welt couplings.

A10.1. The article of footwear of paragraph A10, wherein the one or more welt couplings penetrate the welt, the upper, the at least one anchor tab, and a/the circumferential rib to secure components of the footwear together.

A11. The article of footwear of any of paragraphs A0-A10.1, further comprising a shank disposed between the insole and the outsole.

A12. The article of footwear of any of paragraphs A0-A11, wherein the upper includes a shell configured to extend around the wearer's foot external to the bootie, and a shaft configured to extend away from the shell and the sole assembly along at least a portion of the wearer's leg.

A12.1. The article of footwear of any of paragraphs A0-A12, wherein both the upper and the bootie upper have an exterior side and an interior side arranged opposite the exterior side.

A12.2. The article of footwear of paragraph A12.1, wherein the interior side of the upper is adhered to the exterior side of the bootie.

A13. The article of footwear of any of paragraphs A0-A12.2, further comprising a pull strap disposed on the upper and configured to facilitate a wearer donning and doffing the footwear.

A14. The article of footwear of any of paragraphs A0-A13, wherein the upper includes a sizing mechanism configured to enable a wearer to selectively adjust the fit of the upper on the wearer's foot.

A14.1. The article of footwear of paragraph A14, wherein the sizing mechanism is configured to enable a wearer to selectively adjust a size of an internal volume defined by the upper.

A14.2. The article of footwear of paragraphs A14-A14.1, wherein the sizing mechanism includes one or more of a lace, a zipper, and a snap.

A15. The article of footwear of any of paragraphs A0-A13, wherein the upper is free of a sizing mechanism configured to enable a wearer to selectively adjust the fit of the upper on the wearer's foot.

A16. The article of footwear of any of paragraphs A0-A15, wherein the insole is configured not to be removed from the article without destruction or damage to the article of footwear.

A17. The article of footwear of any of paragraphs A0-A16, wherein the upper is formed from a waterproof material.

A18. The article of footwear of any of paragraphs A0-A17, wherein the article of footwear is a shoe, a running shoe, an athletic shoe, a hiking shoe, sneakers, a waterproof shoe, a boot, a hiking boot, a work boot, a Western boot, an English riding boot, a cowboy boot, a rain boot, a muck boot, a snow boot, and/or a waterproof boot.

B0. A method for manufacturing an article of footwear having at least an upper, a bootie, a sole assembly secured to the upper and to the bootie, and a bootie securement system configured to secure the bootie to the sole assembly, the sole assembly comprising at least an insole and an outsole, and the bootie securement system comprising one or more anchor tabs that extend from the bootie, the method comprising:

securing the bootie to the sole assembly using the bootie securement system;

attaching the upper to the bootie;

lasting the upper to the insole of the sole assembly; and securing the insole to the outsole of the sole assembly.

B1. The method for manufacturing an article of footwear of paragraph B0, wherein securing the bootie to the sole assembly using the bootie securement system includes securing the one or more anchor tabs of the bootie securement system to the sole assembly.

B1.1. The method for manufacturing an article of footwear of paragraph B1, wherein securing the one or more anchor tabs of the bootie securement system to the sole assembly includes:

positioning the one or more anchor tabs adjacent a portion of the insole of the sole assembly; and mechanically securing the one or more anchor tabs to the insole using one or more fixing elements.

B1.1.1. The method for manufacturing an article of footwear of paragraph B1.1, wherein each anchor tab of the one or more anchor tabs comprises a base portion disposed on the bootie and a projecting tab extending away from the base portion, and wherein positioning the one or more anchor tabs adjacent a portion of the insole includes positioning at least a portion of the projecting tab of the one or more anchor tabs on a top surface of the insole.

B1.1.1.1. The method for manufacturing an article of footwear of paragraph B1.1.1, wherein positioning at least a portion of the projecting tab of the one or more anchor tabs on a top surface of the insole includes folding at least a portion of the projecting tab of the one or more anchor tabs under the bootie.

B1.1.2. The method for manufacturing an article of footwear of paragraph B1.1, wherein each anchor tab of the one or more anchor tabs comprises a base portion disposed on the bootie and a projecting tab extending away from the base portion, and wherein positioning the one or more anchor tabs adjacent a portion of the insole includes positioning at least a portion of the projecting tab of the one or more anchor tabs on a bottom surface of the insole.

B1.1.2.1. The method for manufacturing an article of footwear of paragraph B1.1.2, wherein positioning the one or more anchor tabs adjacent a portion of the insole includes wrapping the projecting tab of the one or more anchor tabs at least partially around the insole.

B1.1.3. The method for manufacturing an article of footwear of paragraph B1.1, wherein each anchor tab of the one or more anchor tabs comprises a base portion disposed on the bootie and a projecting tab extending away from the base portion, and wherein positioning the one or more anchor tabs adjacent a portion of the insole includes positioning at least a portion of the projecting tab of the one or more anchor tabs adjacent a peripheral edge of the insole.

B1.2. The method for manufacturing an article of footwear of any of paragraphs B.1.1-B1.1.3, wherein mechanically securing the one or more anchor tabs to the insole using one or more fixing elements includes forming a cold connection between the one or more anchor tabs and the insole.

B1.2.1. The method for manufacturing an article of footwear of paragraph B1.2, wherein the one or more fixing elements comprise stitches.

B1.2.2. The method for manufacturing an article of footwear of paragraph B1.2, wherein the one or more fixing elements comprise staples.

B1.3. The method for manufacturing an article of footwear of any of paragraphs B1.1-B1.2.2, wherein the insole comprises a ribbed insole having a lasting board with a top surface, a bottom surface arranged opposite the top surface, and a circumferential rib protruding from the bottom surface of the lasting board, and wherein positioning the one or more anchor tabs adjacent a portion of the insole includes wrapping the one or more anchor tabs around at least a portion of the insole and over the circumferential protruding rib.

B1.3.1. The method for manufacturing an article of footwear of paragraph B1.3 wherein mechanically securing the one or more anchor tabs to the insole includes stapling the one or more anchor tabs to the circumferential protruding rib.

B1.3.2. The method for manufacturing an article of footwear of paragraph B1.3, wherein mechanically securing the one or more anchor tabs to the insole includes sewing the one or more anchor tabs to the circumferential protruding rib.

B1.3.3. The method for manufacturing an article of footwear of any of paragraphs B1.3-B1.3.2, wherein the one or more fixing elements form a cold connection between the one or more anchor tabs and the circumferential protruding rib.

B1.4. The method for manufacturing an article of footwear of paragraph B1.1, wherein the insole comprises a lasting board having an upper face and a lower face opposite the upper face, and wherein positioning the one or more anchor tabs adjacent a portion of the insole includes wrapping the one or more anchor tabs around at least a portion of the lasting board.

B1.4.1. The method for manufacturing an article of footwear of paragraph B1.4, wherein mechanically securing the one or more anchor tabs to the insole includes mechanically securing the one or more anchor tabs to the lower face of the lasting board using the one or more fixing elements.

B1.4.2. The method for manufacturing an article of footwear of paragraph B1.4, wherein mechanically securing the one or more anchor tabs to the insole includes mechanically securing the one or more anchor tabs to the upper face of the lasting board using the one or more fixing elements.

B1.5. The method for manufacturing an article of footwear of any of paragraphs B1-B1.4.2, wherein securing the one or more anchor tabs of the bootie securement system to the sole assembly additionally or alternatively includes:

adhesively securing the one or more anchor tabs to the insole of the sole assembly.

B1.5.1. The method for manufacturing an article of footwear of paragraph B1.5, wherein adhesively securing the one or more anchor tabs to the insole includes applying a layer of reinforcement adhesive between a/the projecting tab of the one or more anchor tabs and the insole.

B1.5.2. The method for manufacturing an article of footwear of any of paragraphs B1.5-B1.5.1, wherein adhesively securing the one or more anchor tabs to the insole includes positioning a/the projecting tab of the one or more anchor tabs adjacent a portion of the insole of the sole assembly.

B1.5.3. The method for manufacturing an article of footwear of any of paragraphs B1.5-B1.5.2, wherein adhesively securing the one or more anchor tabs to the insole includes pressing a/the projecting tab to the insole to adhere the projecting tab to the insole.

B1.5.4. The method for manufacturing an article of footwear of any of paragraphs B1.5-B1.5.3, wherein the one or more anchor tabs are adhesively secured to the insole prior to mechanically securing the one or more anchor tabs to the insole.

B2. The method for manufacturing an article of footwear of any of paragraphs B0-B1.5.4, wherein the bootie comprises a bootie upper and a bootie base coupled to the bootie upper, and wherein securing the bootie to the sole assembly further includes adhesively securing a bottom of the bootie base to a top of the sole assembly.

B2.1. The method for manufacturing an article of footwear of paragraph B2, wherein adhesively securing the bootie to the insole includes applying an adhesive layer between the bootie base and the insole.

B2.1.1. The method for manufacturing an article of footwear of paragraph B2.1, wherein applying an adhesive layer between the bootie base and the insole includes applying an adhesive layer to a bottom of the bootie base.

B2.1.2. The method for manufacturing an article of footwear of paragraph B2.1, wherein applying an adhesive layer between the bootie base and the insole includes applying an adhesive layer to a top surface of the insole.

B2.1.3. The method for manufacturing an article of footwear of paragraph B2.1, wherein applying an adhesive layer between the bootie base and the insole includes applying an adhesive layer to a bottom of the bootie base and a top surface of the insole.

B2.2. The method for manufacturing an article of footwear of any of paragraphs B2.1-B2.1.3, wherein adhesively securing the bootie to the insole includes orientating the bootie and the sole assembly in a same direction.

B2.3. The method for manufacturing an article of footwear of any of paragraphs B2.1-B2.2, wherein adhesively securing the bootie to the insole includes arranging the bootie over the sole assembly, such that the bootie base is disposed in contact with a top surface of the insole of the sole assembly.

B2.4. The method for manufacturing an article of footwear of any of paragraphs B2.1-B2.3, wherein adhesively securing the bootie to the insole includes pressing the bootie base to the insole of the sole assembly to adhere the bootie to the sole assembly.

B2.5. The method for manufacturing an article of footwear of any of paragraphs B2.1-B2.5, wherein adhesively securing the bootie to the insole produces a combined bootie-insole structure.

B3. The method for manufacturing an article of footwear of any of paragraphs B0-B2.5, wherein a/the bootie base is adhesively secured to the top of the sole assembly prior to mechanically or adhesively securing the one or more anchor tabs to the insole.

B4. The method for manufacturing an article of footwear of paragraph B3, wherein the one or more anchor tabs are adhesively and/or mechanically secured to the insole prior to adhesively securing the bootie base to the top of the sole assembly.

B5. The method for manufacturing an article of footwear of any of paragraphs B0-B4, wherein attaching the upper to the bootie includes adhering the upper to a/the bootie upper.

B5.1. The method for manufacturing an article of footwear of paragraph B5, wherein adhering the upper to the bootie upper includes applying an adhesive between the bootie upper and the upper of the footwear.

B5.2. The method for manufacturing an article of footwear of any of paragraphs B5-B5.1, wherein adhering the upper to the bootie upper includes pressing the bootie upper and the upper of the footwear together to adhere the bootie upper and the upper of the footwear to one another.

B5.3. The method for manufacturing an article of footwear of any of paragraphs B5-B5.2, wherein adhering the upper to the bootie upper includes sewing the bootie upper to the upper of the footwear in one or more spots.

B5.3.1. The method for manufacturing an article of footwear of paragraph B5.3, wherein adhering the upper to the bootie upper includes sewing the bootie upper to the upper of the footwear in a toe region.

B5.3.2. The method for manufacturing an article of footwear of any of paragraphs B5.3-B5.3.1, wherein adhering the upper to the bootie upper includes sewing the bootie upper to the upper of the footwear in a heel region.

B5.4. The method for manufacturing an article of footwear of any of paragraphs B5-B5.3.2, wherein adhering the upper to the bootie upper of the combined bootie-insole structure produces a combined bootie-upper-insole structure.

B6. The method for manufacturing an article of footwear of any of paragraphs B0-B5.4, wherein securing the insole to the outsole includes securing the insole of a/the combined bootie-upper-insole structure to the outsole of the sole assembly.

B6.1. The method for manufacturing an article of footwear of paragraph B6, wherein securing the insole of the combined bootie-upper-insole structure to the outsole of the sole assembly includes the use of an adhesive cement, one or more welt couplings, and/or one or more sole stitches.

B6.2. The method for manufacturing an article of footwear of any of paragraphs B6-B6.1, wherein securing the insole to the outsole includes welting the insole to the outsole.

B6.2.1. The method for manufacturing an article of footwear of paragraph B6.2, wherein welting the insole to the outsole includes:

attaching a welt to the combined bootie-upper-insole structure to form a combined bootie-upper-insole-welt structure; and securing the combined bootie-upper-insole-welt structure to the outsole.

B6.2.1.1. The method for manufacturing an article of footwear of paragraph B6.2.1, wherein attaching a welt to the combined bootie-upper-insole structure includes arranging the welt around a periphery of the combined bootie-upper-insole structure and penetrating the welt, and at least a portion of the upper, the bootie, and the insole of the combined bootie-upper-insole structure with one or more welt couplings to secure components of the footwear together.

B6.2.1.1.1 The method for manufacturing an article of footwear of paragraph B6.2.1.1, wherein the insole is a ribbed insole with a circumferential rib protruding from a bottom surface of the insole, wherein a/the projecting tab(s) of the one or more anchor tabs of the bootie are wrapped over the circumferential rib, and wherein attaching a welt to the combined bootie-upper-insole structure includes penetrating, substantially horizontally, through the welt, and at least a portion of the upper, the projecting tabs of the bootie, and the circumferential rib of the insole using a first welt coupling of the one or more welt couplings to secure the welt to the combined bootie-upper-insole structure.

B6.2.1.2. The method for manufacturing an article of footwear of paragraph B6.2.1.1, wherein securing the combined bootie-upper-insole-welt structure to the outsole includes penetrating, substantially vertically, through the welt of the combined bootie-upper-insole-welt structure and through one or more portions of the sole assembly including the outsole using a second welt coupling of the one or more welt couplings.

B6.3. The method for manufacturing an article of footwear of any of paragraphs B6-B6.2.1.2, wherein securing the insole to the outsole comprises cementing the insole to the outsole using an adhesive.

B6.3.1. The method for manufacturing an article of footwear of paragraph B6.3, wherein cementing the insole to the outsole includes applying the adhesive between a top layer of the outsole and/or a bottom layer of the insole and pressing the insole and the outsole together to securely adhere the insole to the outsole.

C0. Footwear manufactured using the method of any of paragraphs B0-B6.3.1.

D0. The use of the method of any of paragraphs B0-B6.3.1 to manufacture articles of footwear.

D1. The use of the method of any of paragraphs B0-B6.3.1 to manufacture the articles of footwear of any of paragraphs A0-A18.

INDUSTRIAL APPLICABILITY

The footwear, bootie securement systems, and methods disclosed herein are applicable to the footwear industry.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure

The invention claimed is:

1. An article of footwear, comprising:

a bootie configured to receive and enclose a wearer's foot when the footwear is worn by the wearer, wherein the bootie includes at least a bootie upper and a bootie base coupled to the bootie upper;

an upper disposed over the bootie upper;

a sole assembly secured to the upper and the bootie, the sole assembly comprising at least an insole and an outsole; and a bootie securement system securing the bootie to the sole assembly, the bootie securement system including at least one anchor tab that extends from the bootie and is secured to the sole assembly to secure the bootie to the sole assembly.

2. The article of footwear of claim 1, wherein the bootie securement system is configured to prevent detachment of the bootie from the insole during donning and doffing of the article of footwear.

3. The article of footwear of claim 1, wherein the bootie securement system further includes one or more fixing elements that mechanically secure the at least one anchor tab to the sole assembly.

4. The article of footwear of claim 3, wherein the one or more fixing elements includes at least one of stitches and staples.

5. The article of footwear of claim 1, wherein the bootie securement system further includes a reinforcement adhesive that adhesively secures the at least one anchor tab to the sole assembly.

6. The article of footwear of claim 1, wherein the at least one anchor tab is secured to the insole of the sole assembly.

7. The article of footwear of claim 6, wherein the bootie securement system further comprises one or more fixing elements; wherein the at least one anchor tab is wrapped around at least a portion of the insole; and wherein the at least one anchor tab is mechanically secured to the insole by the one or more fixing elements.

8. The article of footwear of claim 7, wherein the insole comprises a lasting board having an upper face and a lower face opposite the upper face; and wherein the at least one anchor tab is wrapped around the lasting board and mechanically secured to the lower face of the lasting board by the one or more fixing elements.

9. The article of footwear of claim 7, further comprising a welt that extends around a periphery of the footwear and secures the upper and the bootie to the sole assembly using one or more welt couplings; and wherein the one or more welt couplings penetrate at least the welt, the upper, and the at least one anchor tab.

10. The article of footwear of claim 6, wherein at least a portion of the at least one anchor tab is disposed between the insole and the outsole.

11. The article of footwear of claim 6, wherein the bootie securement system further comprises one or more fixing elements; wherein the insole comprises a ribbed insole having a lasting board with a top surface, a bottom surface opposite the top surface, and a circumferential rib protruding from the bottom surface of the lasting board; wherein the at least one anchor tab is wrapped around at least a portion of the circumferential rib and fixed thereat by the one or more fixing elements; and wherein the one or more fixing elements penetrate through the at least one anchor tab and the circumferential rib to mechanically secure the bootie to the ribbed insole.

12. The article of footwear of claim 11, wherein the bootie securement system includes a reinforcement adhesive, and further wherein the at least one anchor tab is wrapped around at least a portion of the circumferential rib and adhesively secured thereat with the reinforcement adhesive.

13. The article of footwear of claim 1, wherein the bootie includes a hindfoot region, and wherein the at least one anchor tab projects outwards from the hindfoot region of the bootie.

14. The article of footwear of claim 1, wherein the bootie base includes a waterproof gasket, and further wherein the at least one anchor tab extends from the waterproof gasket.

15. The article of footwear of claim 1, wherein the at least one anchor tab is integrally formed with the bootie.

16. The article of footwear of claim 1, further comprising an insertable footbed disposed within the bootie above the bootie base and configured to contact the wearer's foot when the footwear is worn by the wearer.

17. The article of footwear of claim 1, wherein the bootie is formed from a waterproof material.

18. The article of footwear of claim 1, wherein the insole includes a top surface, the bootie base includes a bottom surface, and the top surface of the insole is adhesively secured to the bottom surface of the bootie base.

19. The article of footwear of claim 1, wherein the bootie is configured to at least substantially enclose the wearer's foot when the article of footwear is worn.

20. The article of footwear of claim 1, wherein the bootie is secured within the article of footwear such that the bootie is not configured to be selectively removed from the article of footwear without damaging or destroying at least a portion of the article of footwear.

* * * * *